US007682297B2

(12) United States Patent
Graham

(10) Patent No.: US 7,682,297 B2
(45) Date of Patent: Mar. 23, 2010

(54) TREATMENT TABLE AND EXERCISE DEVICE METHOD AND APPARATUS

(76) Inventor: Gary Graham, P.O. Box 5146, Glacier, WA (US) 98244

( * ) Notice: Subject to any disclaimer, the term of this patent is extended or adjusted under 35 U.S.C. 154(b) by 96 days.

(21) Appl. No.: 11/549,902

(22) Filed: Oct. 16, 2006

(65) Prior Publication Data

US 2007/0087921 A1 Apr. 19, 2007

Related U.S. Application Data

(60) Provisional application No. 60/726,782, filed on Oct. 14, 2005.

(51) Int. Cl.
*A63B 21/02* (2006.01)

(52) U.S. Cl. ..... 482/122; 482/121; 482/142

(58) Field of Classification Search ..... 482/121–122, 482/142, 148, 123, 132; 601/1, 5
See application file for complete search history.

(56) References Cited

U.S. PATENT DOCUMENTS 2,340,666 A 2/1944 Johanson
2,664,886 A 1/1954 Coffman
3,620,530 A 11/1971 Cosby
3,770,267 A * 11/1973 McCarthy ..... 482/130
4,004,801 A 1/1977 Campanaro et al.
4,561,649 A 12/1985 Forsythe
4,706,953 A 11/1987 Graham
4,869,499 A 9/1989 Schiraldo
4,884,802 A 12/1989 Graham
5,039,093 A 8/1991 Collier
5,042,797 A 8/1991 Graham
5,066,005 A * 11/1991 Luecke ..... 482/96
5,260,870 A 11/1993 Tsuchiya et al.
5,279,530 A 1/1994 Hess
5,312,315 A 5/1994 Mortensen et al.
5,318,495 A 6/1994 Malynowsky
5,364,327 A * 11/1994 Graham ..... 482/122
5,499,958 A 3/1996 Hess
5,599,260 A 2/1997 Rovinsky et al.
5,620,403 A * 4/1997 Lundin ..... 482/96
5,645,516 A 7/1997 Foster
5,653,667 A 8/1997 Reyes
5,681,249 A * 10/1997 Endelman ..... 482/142
6,010,434 A * 1/2000 Hodges ..... 482/57
6,042,523 A * 3/2000 Graham ..... 482/121
6,120,425 A * 9/2000 Endelman ..... 482/142
6,186,929 B1 * 2/2001 Endelman et al. ..... 482/121
6,338,704 B1 * 1/2002 Endelman ..... 482/142
6,371,895 B1 * 4/2002 Endelman et al. ..... 482/135
6,383,122 B1 * 5/2002 Graham ..... 482/122
6,527,685 B2 * 3/2003 Endelman et al. ..... 482/121
6,685,606 B2 * 2/2004 Endelman ..... 482/142
6,827,675 B1 * 12/2004 Graham ..... 482/122
6,926,650 B2 * 8/2005 Endelman et al. ..... 482/121
6,971,976 B2 * 12/2005 Endelman et al. ..... 482/121

(Continued)

*Primary Examiner*—Lori Baker
(74) *Attorney, Agent, or Firm*—Michael F. Hughes; Hughes Law Firm, PLLC

(57) ABSTRACT

An exercise and therapeutic apparatus having a kick plate that is adapted to be stored in an operable position where it is in a substantially vertically orientated manner where the kick plate is in a more vertically orientated or positioned orientation with respect to a frame and a carriage is movably attached in a substantially horizontal direction where a resistance system provides resistant movement of the carriage with respect to the frame. The kick plate is further adapted or operatively configured to be re-orientated in a stowed position where an upper surface of the kick plate operates in conjunction with an upper surface of the carriage to function as a table like support.

20 Claims, 20 Drawing Sheets

U.S. PATENT DOCUMENTS

| | | | | |
|---|---|---|---|---|
| 7,104,937 | B2 * | 9/2006 | Arbuckle et al. | 482/142 |
| 7,125,368 | B2 * | 10/2006 | Endelman | 482/142 |
| 7,125,369 | B2 * | 10/2006 | Endelman | 482/142 |
| 7,163,500 | B2 * | 1/2007 | Endelman et al. | 482/142 |
| 7,288,053 | B2 * | 10/2007 | Endelman et al. | 482/142 |
| 7,288,054 | B2 * | 10/2007 | Endelman et al. | 482/142 |
| 7,465,261 | B2 * | 12/2008 | Barnard et al. | 482/142 |
| 2001/0056011 | A1 * | 12/2001 | Endelman et al. | 482/121 |
| 2002/0058573 | A1 * | 5/2002 | Endelman et al. | 482/142 |
| 2003/0119635 | A1 * | 6/2003 | Arbuckle et al. | 482/142 |
| 2003/0119636 | A1 * | 6/2003 | Endelman | 482/142 |
| 2003/0195095 | A1 * | 10/2003 | Endelman et al. | 482/142 |
| 2004/0176227 | A1 * | 9/2004 | Endelman | 482/142 |
| 2005/0085357 | A1 * | 4/2005 | Endelman | 482/142 |
| 2005/0113226 | A1 * | 5/2005 | Endelman et al. | 482/142 |
| 2005/0113227 | A1 * | 5/2005 | Endelman et al. | 482/142 |
| 2006/0035769 | A1 * | 2/2006 | Phillips | 482/123 |
| 2006/0046914 | A1 * | 3/2006 | Endelman et al. | 482/142 |
| 2006/0148625 | A1 * | 7/2006 | Garner | 482/123 |
| 2006/0189438 | A1 * | 8/2006 | Black | 482/8 |
| 2006/0199712 | A1 * | 9/2006 | Barnard et al. | 482/142 |

* cited by examiner 304
336
8
302
52
54
324
8
322
260
24
300
152
101
150
311
311
254
26
312
373
30
90
314
306
22
49
50
250
313
310
22
24
252

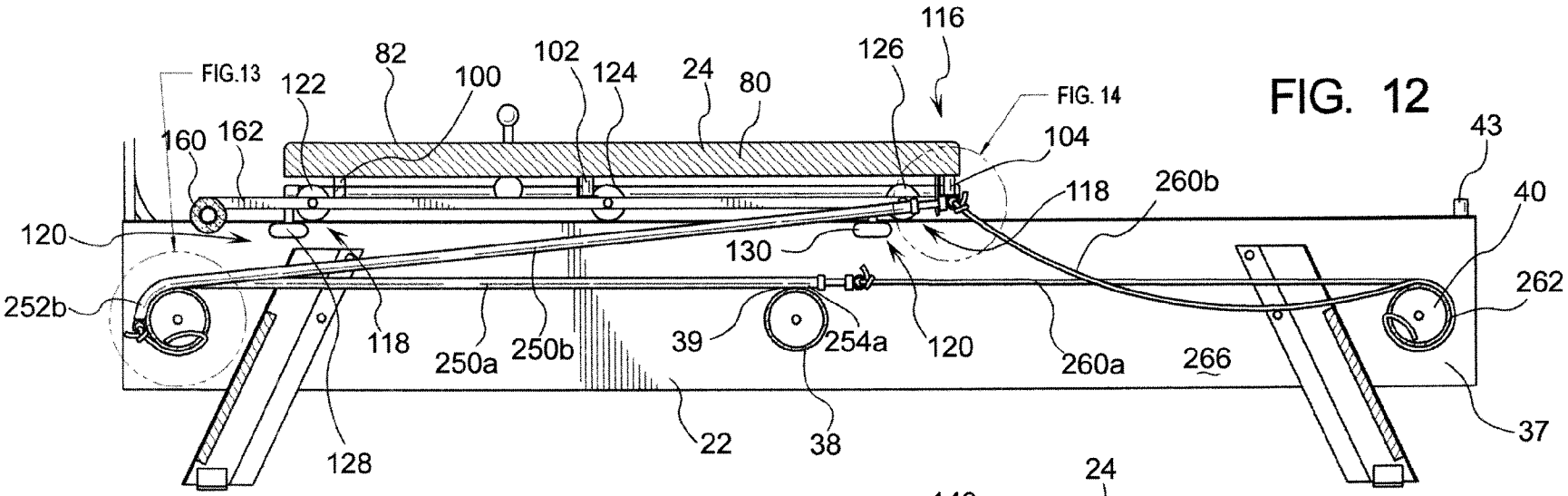
FIG. 12
43
40
262
37
260b
266
260a
FIG. 14
104
118
116
126
120
254a
38
130
39
80
24
22
124
102
250b
100
250a
82
118
128
122
162
FIG.13
160
120
252b
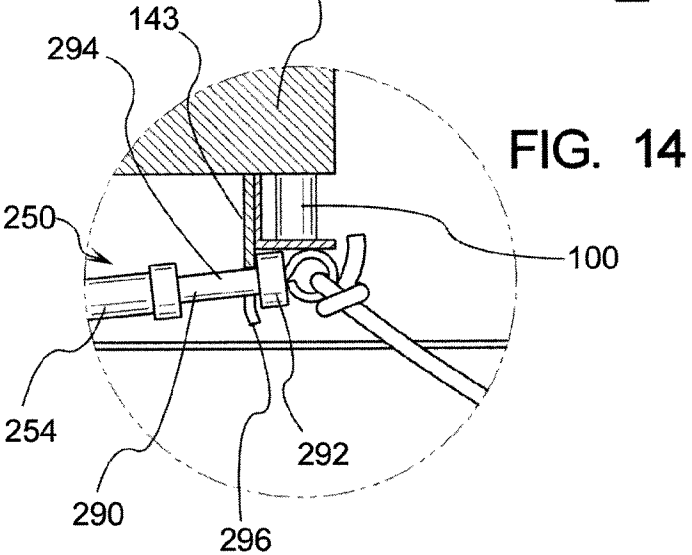
FIG. 14
100
24
292
296
143
290
294
250
254
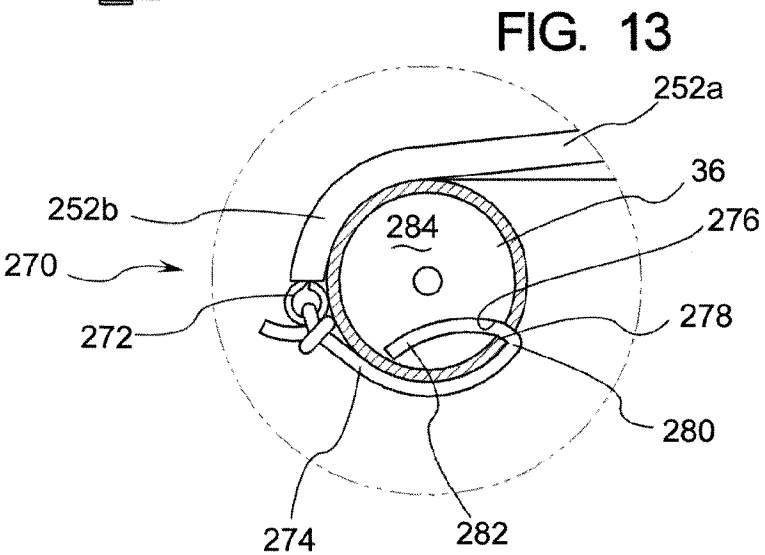
FIG. 13
252a
36
276
278
280
282
284
274
252b
272
270

TREATMENT TABLE AND EXERCISE DEVICE METHOD AND APPARATUS

RELATED APPLICATIONS

This application claims priority benefit of a U.S. Provisional having Ser. No. 60/726,782, filed Oct. 14, 2005.

BACKGROUND OF THE DISCLOSURE

The invention relates to an exercise and therapeutic apparatus and more specifically the configuration of a wheel tracking system, load resistance configuration and combination treatment table.

The invention relates to the art of exercise apparatus that generally consists of a stationary frame, a horizontal moving carriage, a vertical folding kick plate, a resistance system, a rebound system and an adjustable range of motion system. The exercising participant is positioned supine on a reciprocating moveable carriage with one or both feet on a vertical kick plate. The participant induces an oscillating or reciprocating motion in a longitudinal direction to the carriage against a variable resistance. The kick plate is normally attached to the foot end portion of the frame.

SUMMARY OF THE DISCLOSURE

Disclosed below is an exercise apparatus generally comprising a frame, a carriage, a kick plate and a resistance system. The support structure frame having a foot end, a head end, a leftward portion, and a rightward portion. A carriage is provided having a footer portion, a header portion, a vertically upward surface, a vertically downward surface, a leftward lateral side and a rightward lateral side, the carriage being movably coupled to the support structure frame toward the head end of the frame to travel back and forth longitudinally along the frame. A plurality of elastic members coupled to the foot end of the frame on a first end and removably coupled to the carriage on a second end. A kick plate is provided and is movably coupled to the support structure frame toward the foot end of the frame such that it is rotationally positionable in a horizontal and a vertical position having a vertically upward surface and a vertically downward surface when in the horizontal position and the vertically upward surface of the kickboard when in the horizontal position is substantially continuous with the vertically upward surface of the carriage when the kickboard is in the stowed position.

The exercise apparatus can be arranged so the vertically upward surface of the carriage and the vertically upward surface of the kickboard when in the horizontal position are padded. The exercise apparatus as recited in claim 1 wherein the rebound system can be adjusted by way of a rope means and an adjustment means coupled to the frame of the exercise apparatus.

A plurality of lateral control wheels can be provided and coupled to the carriage configured so that the plane of rotation of the lateral control wheels is in a plane parallel with the longitudinal movement of the carriage along the frame and the lateral control wheels are in contact or intermittent contact with an L shaped bracket coupled to the frame. The L shaped bracket prevents the carriage from becoming detached from the frame and reduces friction between the carriage and the support structure frame.

The exercise apparatus further including a headrest positionably coupled to the vertically upward surface of the carriage.

A locking mechanism can be employed to orientate the kickboard to an operable orientation from a stowed position. The locking mechanism includes a loop leverage fastener where the kickboard further comprises downward extending members, each having a receiving portion where a loop member is pivotally attached to the base frame and adapted to replace a downward force upon the downward extending members of the kick plate.

The rebound system can be comprised of a first and second cord sections where the first ends of the cord sections are attached to the carriage and second ends are operatively attached to the frame. The first and second cord sections are further attached to first and second cord extension portions where the length of the first and second cord sections can be adjusted by adjusting the length of the first and second cord extension portions.

The first and second cord sections in one form have an elastic member attached thereto to resist lateral displacement of the first and second cord sections. The first and second cord portions are attached to one another in a central location and a fastener is attached thereto which is fixedly and removably displaced in a longitudinal direction to adjust the lengths of the first and second cord sections.

As described in detail herein the carriage is provided with an adjustable head rest positioning system where a headrest comprising a head rest member that is fixedly and repositionally positioned upon the carriage.

Referring still to the carriage, a vertically extending member of the carriage comprises an attachment system where surfaces define a plurality of slots of attachment regions positioned vertically to proximately correlate to the lateral position of elastic members of the resistant system. The carriage can further have a foot rest member provided and positioned sufficiently below an upper surface of the carriage member such that the kick plate is positioned there above the foot rest member when in a stored orientation.

The resistant system of the exercise apparatus comprises a plurality of elastic members where at least a portion of the elastic members are attached to a portion of the frame where a fixing cord located at a first region of an elastic member at least one of the elastic members extends through an opening at a substantially right angle to the portion of the fixing cord adjacent to the first end of the elastic member to secure the elastic member to the frame where a spreader bar is provided to separate first and second frame members longitudinally extending frame members of the frame where the spreader bar is positioned at a foot region of the frame and includes a surface defining an opening adapted.

The frame can have a spreader bar positioned at a foot region of the frame where the spreader bar provides the opening for the fixing cord of an elastic member and the spreader bar defines an interior chamber region where an internal end of the fixing cord extends therein. The tension of the elastic member is adapted to be changed by way of first relaxing the tension in the elastic member and adjusting the length of the fixing cord within the opening.

The resistant system comprises at least one elastic member where the elastic member has first and second ends where attached at the first end is a fixing cord that is operatively configured to extend through the opening of the spreader bar to fix the first end of the elastic cord to the frame. The elastic cord further comprises an attachment cord portion that is connected to the second end of the elastic member and further connected to a second spreader bar positioned at the head region of the frame.

A motion control system is provided and comprises an operating region having first and second cord sections each having a portion being attached to the frame and an opposing portion attached to the carriage, an elastic member attached to the first and second cord sections resisting separation in a lateral direction of the first and second cord sections.

The first and second members extend though contact points of the frame and extend in a longitudinal headward direction where the first and second members are adjusted in length by fixedly attaching the first and second members to the frame.

The first and second cord sections are attached to one another at the headward region of the frame and an adjustment mechanism is provided where an attachment member is configured to be fastened to a spreader bar positioned in the head-region of the frame.

BRIEF DESCRIPTION OF THE DRAWINGS

FIG. 12 shows a sectional view in the lateral direction where one elastic member is engaged with the carriage and a second elastic member is shown in a disengaged orientation;

FIG. 13 is a close up view of the attachment of a method of attaching the elastic members to the frame;

FIG. 14 shows a method of attaching the elastic members to the carriage;

DESCRIPTION OF THE PREFERRED EMBODIMENTS

Figure 1:
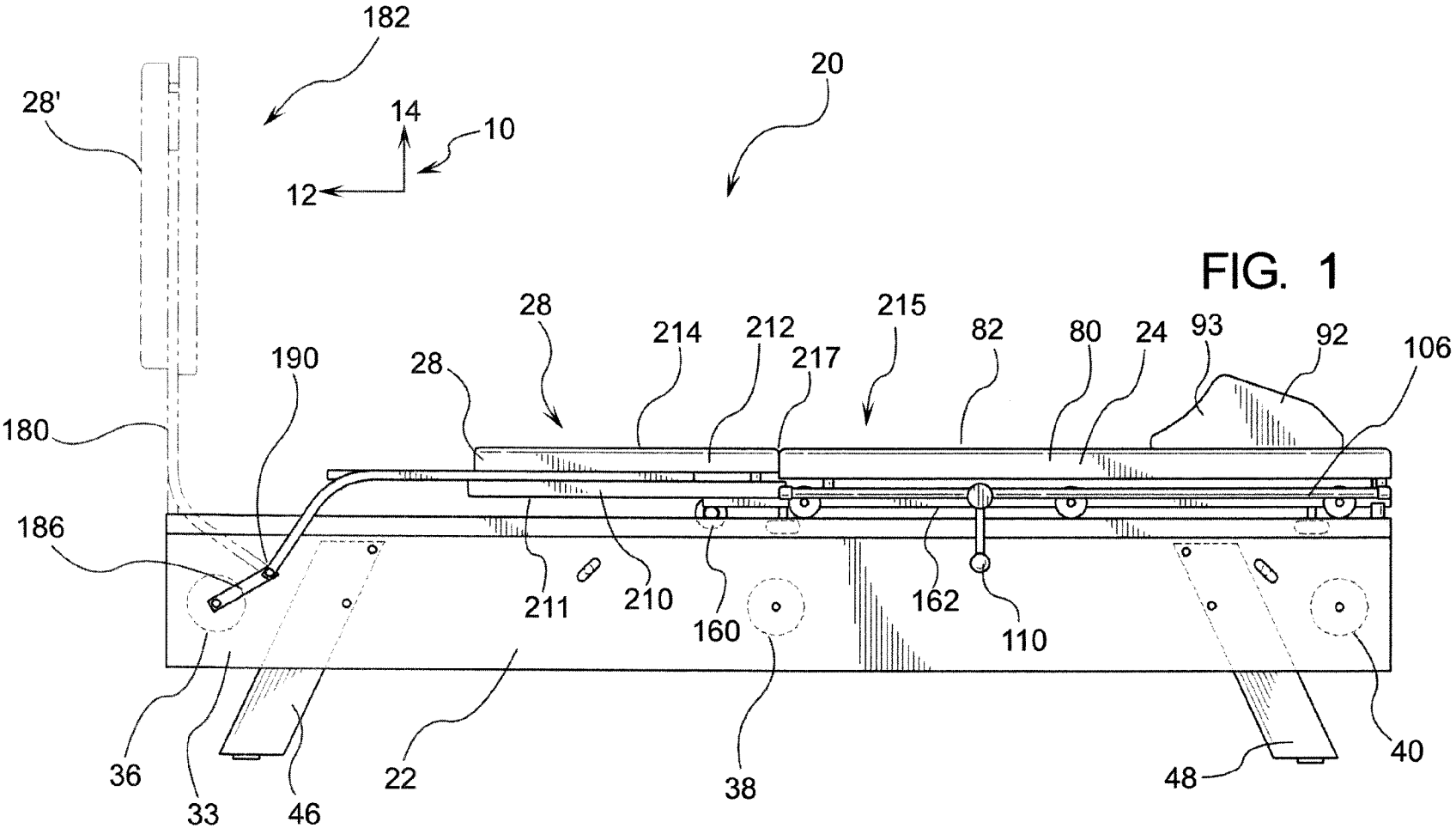
FIG. 1 shows a side view of the apparatus.
Figure 2:
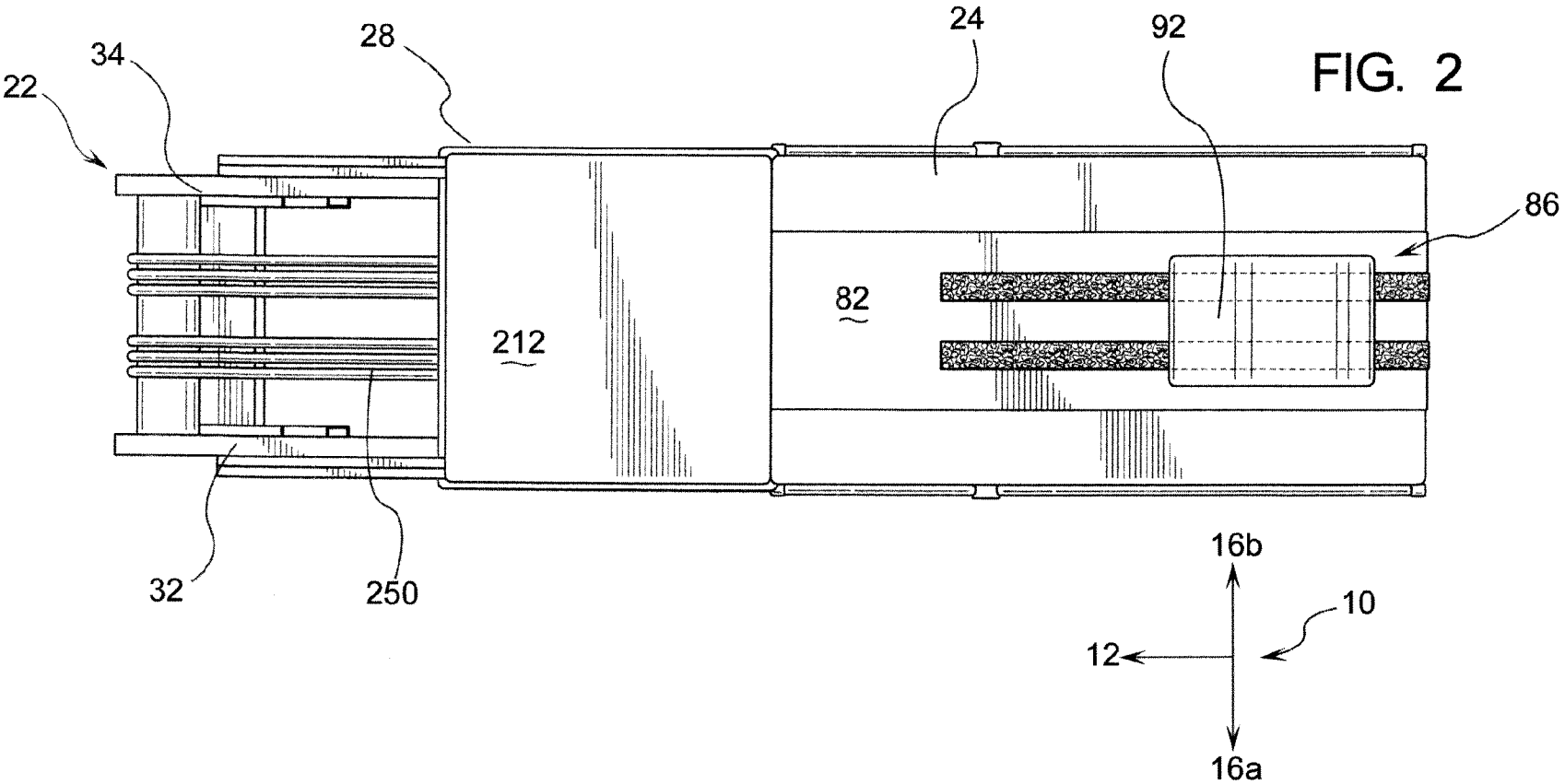
FIG. 2 shows a top view of the apparatus with the kick plate in a stowed or horizontal orientation.
Figure 6:
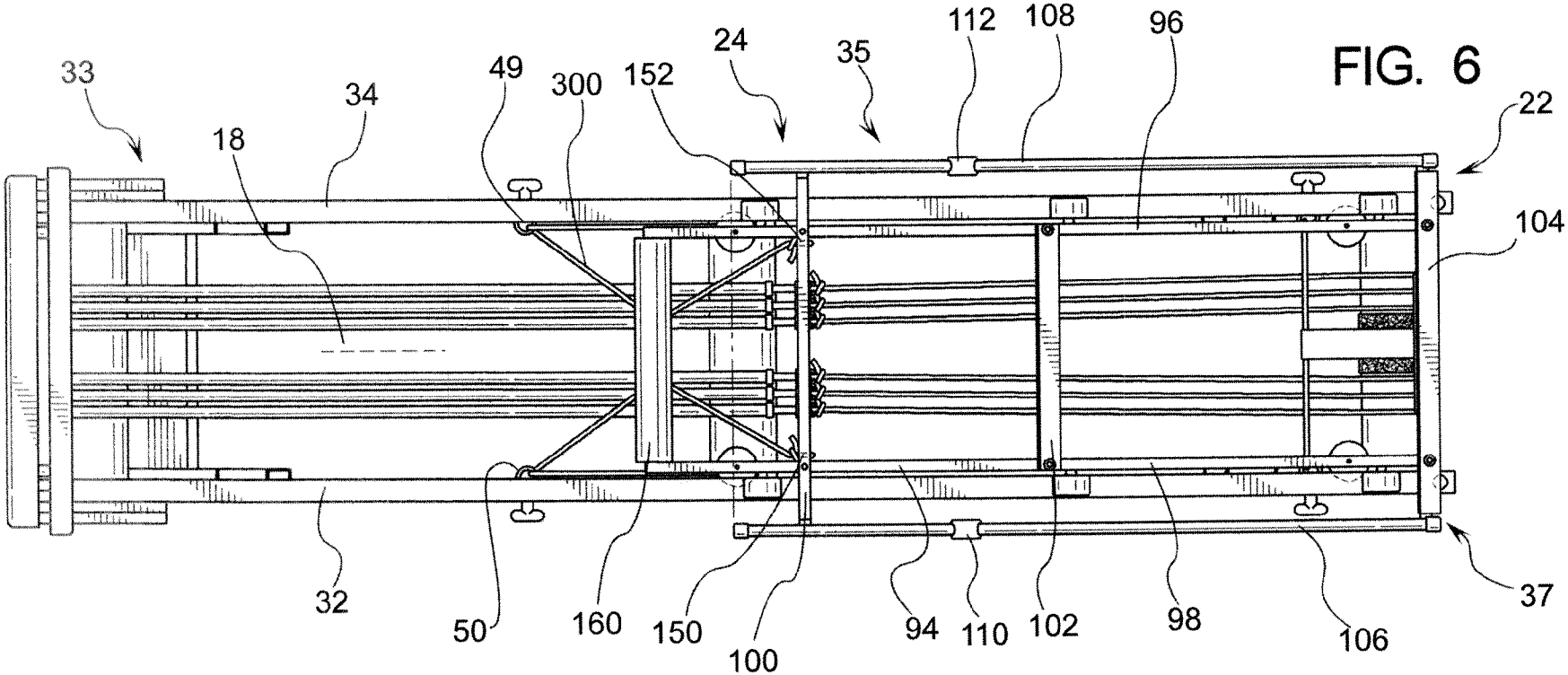
FIG. 6 is taken along line 6-6 of FIG. 3 showing the rebound system and the resistance system.

Referring to FIG. 1, there is the apparatus 20 which is shown in a stowed orientation wherein the left-hand portion kick plate 28 is shown in an inoperative orientation. Before going into a more detailed discussion, an axis system 10 is utilized to help describe the drawings herein. In general, the axis indicated at 12 indicates a longitudinal direction and the arrow points in a foot-ward direction. The axis indicated at 14 is a vertical axis and indicates a vertical direction. An axis system 10 as shown in FIG. 2 at 16A and 16B indicates a lateral direction where 16A is directed to a direction herein referred to as the left direction and 16B indicates a rightward direction. As shown in FIG. 6, a center axis is shown that is positioned substantially at the lateral symmetrical center of the apparatus 20. Of course, the axis described hereunder are for general reference purposes and are not necessarily orthogonal but generally indicate directions for ease of description and general orientation of components described herein.

In general, the apparatus 20 is comprised of a support frame/frame member 22, a carriage 24, a resistance system 26, a kick plate 28 and further in one form, a rebound system 30 or otherwise referred to herein as a range of motion control system.

Figure 3:
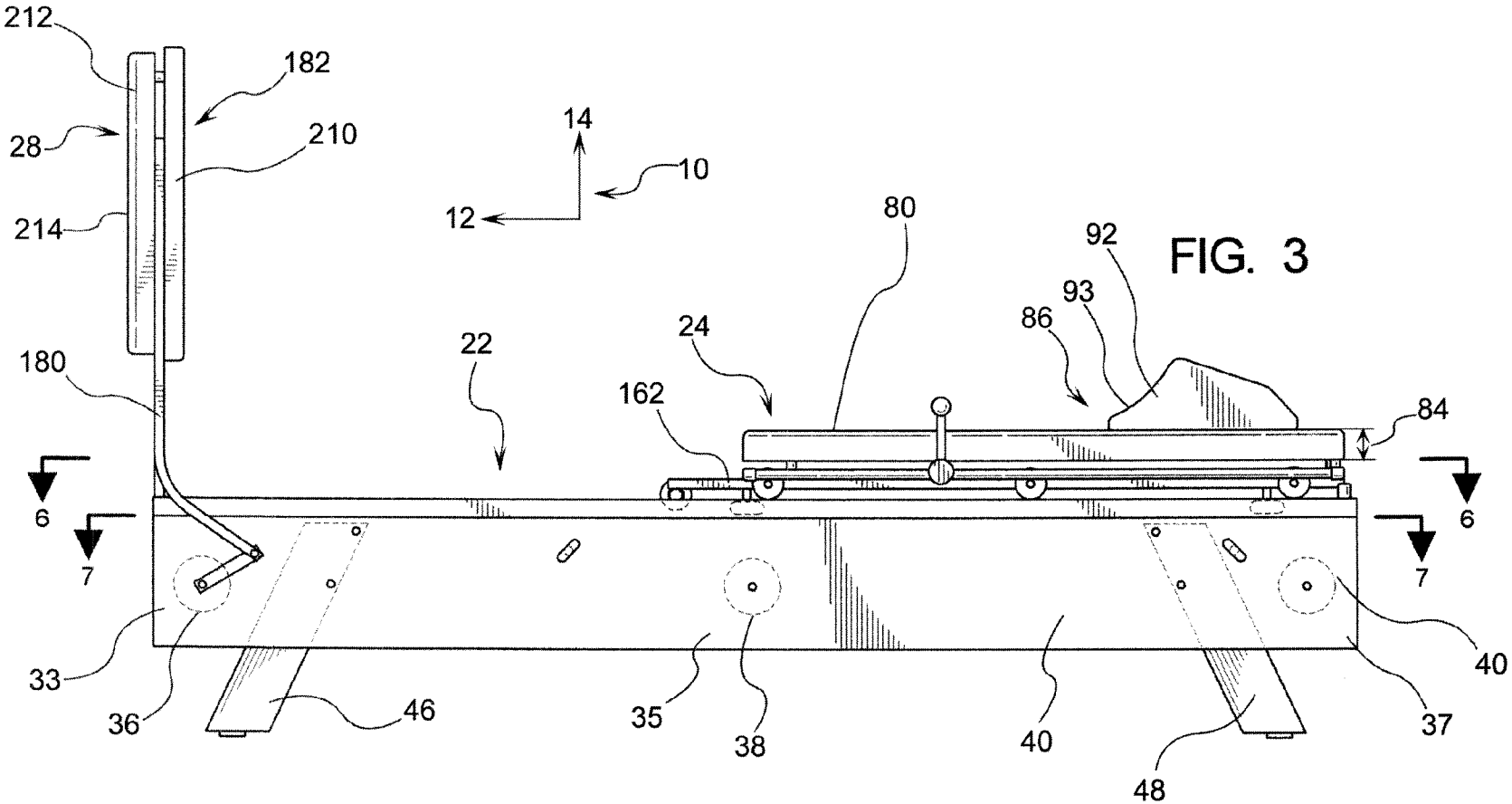
FIG. 3 shows the apparatus in a side view with the kick plate in an operable orientation and the carriage positioned in a longitudinally head ward orientation.

As shown in FIG. 2, the support frame/frame member 22 comprises in one form two longitudinally extending frame members 32 and 34 in one form. The longitudinally extending frame members 32 and 34 are connected by way of a plurality of spreader bars which are best shown in FIG. 3 in a hatched line at 36, 38, and 40. In one form, there are three spreader bars employed where the spreader bar 36 is positioned at the foot region 33 of the support frame/frame member 22 and the spreader bar 40 is positioned at the longitudinal head portion 37. In general, the support frame/frame member 22 as shown in FIG. 6 generally comprises a foot region 331 the central region 35 and a longitudinal head portion 37. In one form, a plurality of legs generally indicated at 46 and 48 are utilized to hold the longitudinally extending frame members 32 and 34 upwardly. As shown in FIG. 6, the support frame/frame member 22 has connection points 49 and 50 positioned at adjacent sides of the frame member that operate in conjunction with the rebound system 30 as further described herein with reference to FIG. 7. Further, as shown in for example FIG. 7, the second set of mounting points indicated at 52 and 54 are further provided which further operate in coordination with the rebound system 30. As shown in FIG. 8, the legs 48 comprise the foot engagement portion 60 at a laterally extending plate 62 which is connected to two laterally adjacent legs 48 for rigidity and support. In some forms, the legs 48 can fold for a shipping or storage type orientation. Otherwise, the legs can be rigidly attached to each of the longitudinally extending frame members frame members 32 and 34 at the attachment points generally indicated at 64 as shown in FIG. 8.

Figure 5:
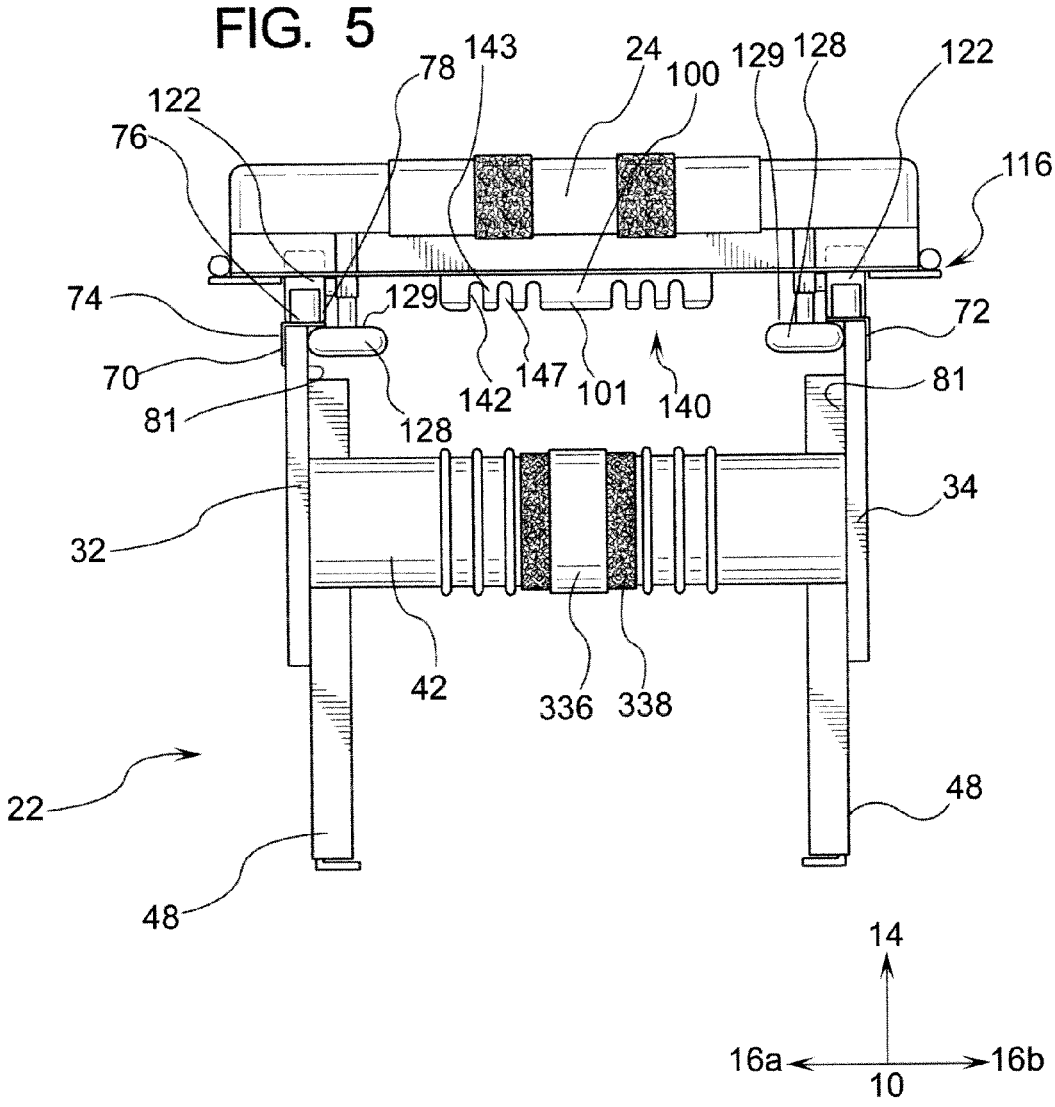
FIG. 5 is a view taken in a longitudinal direction at the head ward region of the apparatus.

Now referring to FIG. 5, it can be seen along the longitudinal axis how the longitudinally extending frame members 32 and 34 are positioned in a substantially vertical orientation. In the upper portion of each of these frame members are wheel engaging members 70 and on the opposing side a similar type member 72. In general, the wheel engaging members 70 and 72 are fixedly attached to the longitudinally extending frame members 32 and 34. As further shown in FIG. 5, in one form, the wheel engaging members 70 and 72 have a vertically orientated portion 74 and a horizontally extending region 76. In one form, the horizontally extending region 76 has an extension 78 which extends beyond the surface defined by the plane which in turn is defined by the upper surface of say for example the longitudinally extending frame member 34. Of course, this discussion is relevant and for the opposing longitudinally extending frame member 32. As described further herein, this arrangement is effective because the weight support wheels 122 and the lateral controlling wheels 125 operate with the extension 78 and the upper surface of the horizontally extending region 76 to keep the carriage 24 movably positioned upon the support frame/ frame member 22. As shown in FIG. 12, a stopper member 43 is provided at the longitudinal head portion 37 of the frame. This allows for maintaining the carriage 24 upon the support frame/frame member 22.

Referring to FIG. 5, there will now be a discussion of the spreader bars with particular reference to the spreader bar 40. It should be noted that not only are the spreader bars 36, 38 and 40 provided for structural integrity for the support frame/frame member 22, but further, can serve utility such as providing a location for fixedly and removably positioning certain members of the rebound system 30 for adjustment thereof. This will be described further herein in detail below.

Figure 4:
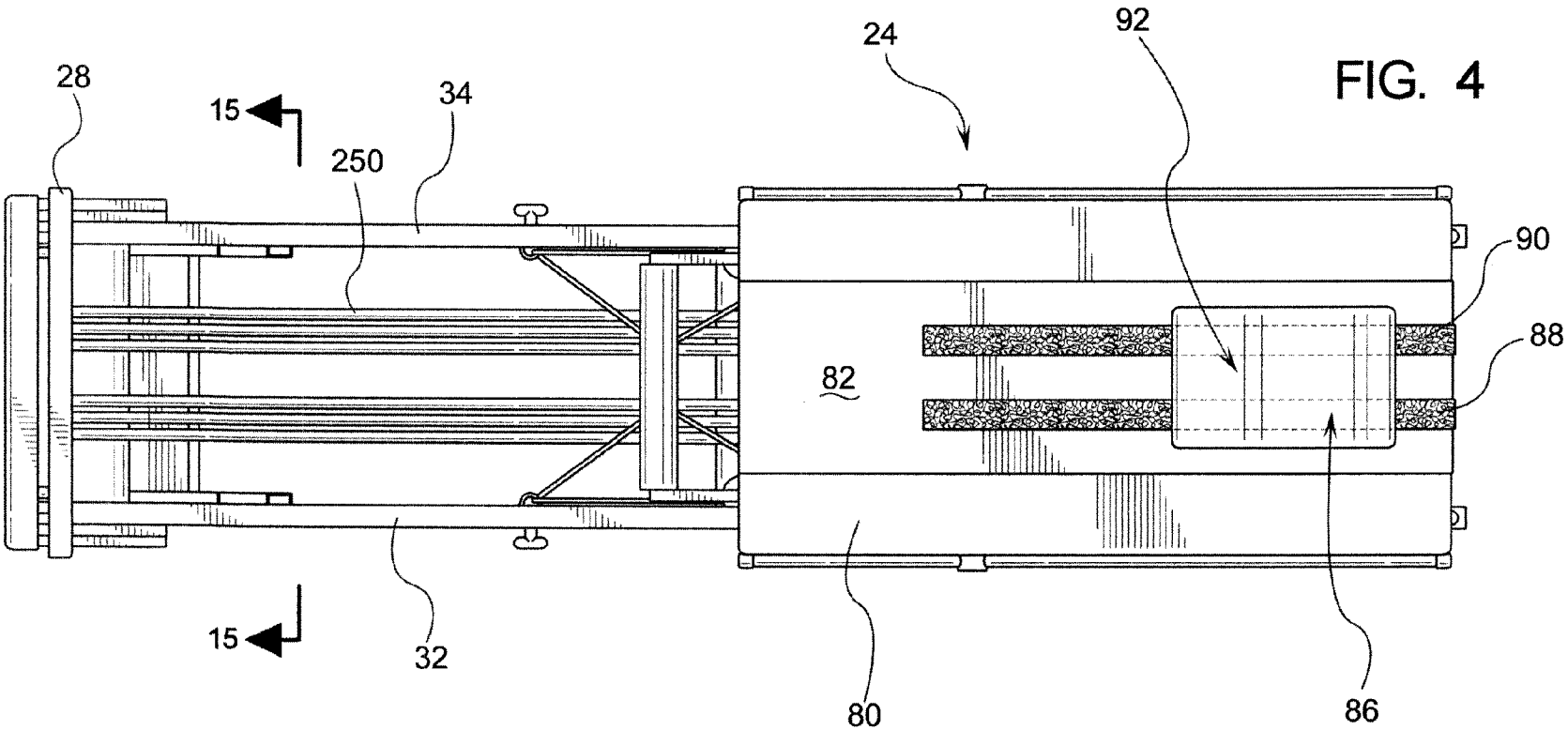
FIG. 4 shows a top view of the apparatus with the kick plate in an operational orientation.
Figure 23:
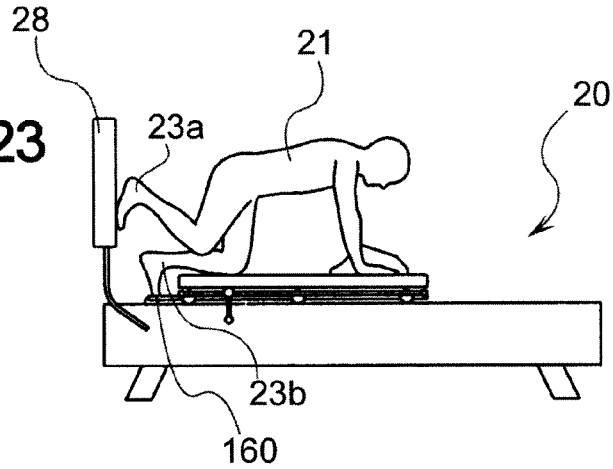
Figure 24:
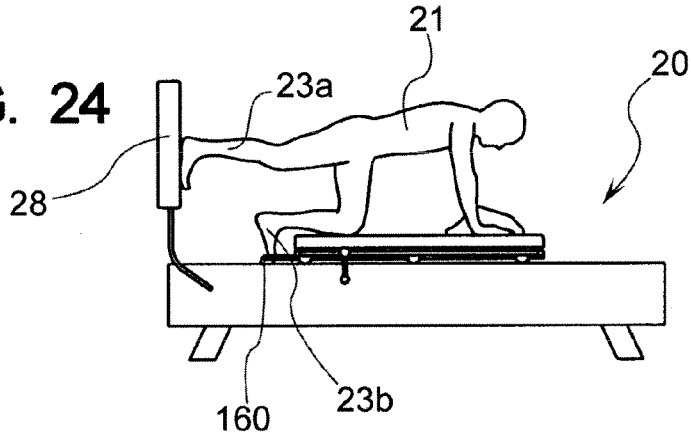

With the foregoing description of the support frame/frame member 22 in mind, now referring to FIG. 3 there will be a more detailed discussion of the carriage 24. In general, the carriage operates to be movably positioned in a longitudinal direction with the frame member. Referring to FIG. 4, there is a top view of the carriage 24 where it can be seen how the carriage is provided with a base member 81 which has an upper surface 82 that is adapted to support a patient thereon. In general, as shown in FIG. 3, the base member 80 has a thickness indicated at 84 which, as seen in FIG. 1, is generally provided to include a certain amount of padding to conform to the contour of an exercising participant laying thereon. As described further herein with reference to FIGS. 16-28, there are numerous orientations an individual can be positioned upon this base member some of which are in a sideways orientation as in FIGS. 19-22 where their hips would engage the padding or a downward facing kneeling like stance as shown in FIGS. 23-24 where their knees would need to engage the padding for comfort and proper support. As further shown in FIG. 4, the upper surface 82 can be provided with an adjustable headrest positioning system 86 which in one form comprises a hook and loop like fastening system where hook and loop fasteners 88 and 90 are attached to the upper surface or a part of the upper surface 82. In one form two longitudinal extending strips of hook and loop type fasteners can be utilized but of course a plurality of modifications and orientations can be employed. As shown in FIG. 3, the headrest 92 is optionally employed and is fixedly and repositionally attached to the upper surface 82 by way of having a corresponding hook and loop fastener system to cooperate with the hook and loop fasteners 88 and 90. Now referring to FIG. 3, the headrest 92 has a forward surface 93 adapted to receive force from the individual 21. Of course in one preferred form, the softer less rigid strouds section of the portion of the hook and loop fastening system can be positioned on the upper surface 82 for comfort of the user.

Now referring to FIG. 6, this Fig. essentially shows the frame member 94 of the carriage system. FIG. 6 is taken at line 6-6 of FIG. 3 and basically shows the lower portion of the support frame/frame member 22 with removal of the base member 81. In one form, the base member 81 is removable for maintenance or cleaning of the unit. As shown in FIG. 6, the frame member 94 comprises first and second longitudinal frame members 96 and 98. In one form, the longitudinal carriage frame members are positioned inwardly from the longitudinally extending frame members 32 and 34. The frame members are in general positioned laterally outward from the center axis 18 of the machine and are connected by one or more laterally extending members. In one form, the frame member 94 of the carriage 24 is comprised of three laterally extending members which are indicated at 100, 102 and 104. As described further herein, the laterally extending members such as the member 100 can be further utilized to engage the resistance system 26 (not shown in FIG. 6) for application of elastic members attached thereto. In one form, positioned laterally outwardly from the unit are first and second guide bars 106 and 108; The handle members 110 and 112 are optionally attached thereto and as shown for example at FIG. 1 can be positioned in a downward orientation or in an outward orientation for grasping by the exercising participant of the apparatus 20.

Referring now to FIG. 12, there will now be a discussion of the mobility system 116 of the carriage 24. In one form, the mobility system is comprised by a plurality of wheels or bearing like members. In general, in one form the wheels can be separated into the weight bearing wheel system generally indicated at 118 and the lateral wheel bearing system 120. As shown in FIG. 12, the weight bearing wheel system 118 is comprised of three sets of wheels (in one form) generally indicated as 122, 124 and 126, which are orientated substantially along a horizontal axis. Further, the lateral wheel bearing system 120 in one form is comprised of two pairs of the wheel members indicated at 128 and 130 which are orientated substantially about a vertical axis. As introduced above, with reference to FIG. 5, the mobility system 116 cooperates with the frame member where for example the wheel members 128 are adapted to engage the base member 80 of the longitudinally extending frame members 32 and 34. The upper surface 129 of the laterally extending wheels 128 can be utilized to engage the extension 78 in dynamic situations described below. Of course, other materials can interpose there between but the base structural member in this property of the longitudinally extending frame members 32 and 34 provide a rigid platform for the lateral wheel bearing system 120 to prevent an excessive amount of rotation of the carriage about a vertically orientated axis. Oftentimes it is desirable by the exercising participant to have more of a linear, longitudinal motion with a minimal amount of "rattling" or undesirable friction or lateral movement of any form. Of course, these members can be orientated with a slight interference fit to put a slight outward pressure between the wheel members 128 and the longitudinally extending frame members 32 and 34.

Still referring to FIG. 5, it can be seen how the weight bearing rearward orientated bearings or weight support wheels 122 are shown resting upon the upper portion of the longitudinally extending frame members 32 and 34. As described above, in one form the wheel engaging members 70 and 72 are utilized to provide a surface for these wheels and the upper surface 129. The upper surface 129 of the wheels 128 can engage the lower surface of the extension 78 as shown in FIG. 5 in the event that there is a vertical force upon the support frame/frame member 22. Although this would happen infrequently, these extensions would prevent the carriage member from lifting off or being separated from the carriage 24 above.

Still referring to FIG. 5, there is shown an attachment system 140 where in one form the laterally extending member 100 is comprised of surfaces 142 defining the plurality of slots 147 defining an attachment region. In general, the lateral positioning of the slots at least partially correlates with the orientation of the elastic members 250 as shown in FIG. 6. Between the plurality of slots 147 are extension members 143 which, as shown in FIG. 14, have a slight longitudinal headward extension 296 to more properly engage the head portion 292 of the attachment portion 290 of the elastic members 250. As described further herein with reference to the resistance system 26, this attachment system 140 as shown in FIG. 5 provides a convenient attachment location for one or more elastic members 250 of the resistance system 26 for providing selective resistance of the carriage in a longitudinal direction with respect to the support frame/frame member 22. Therefore, in one form, the attachment system 140 can function as the elastic member attachment portion 101 of the resistance system 26 described herein.

Figure 7:
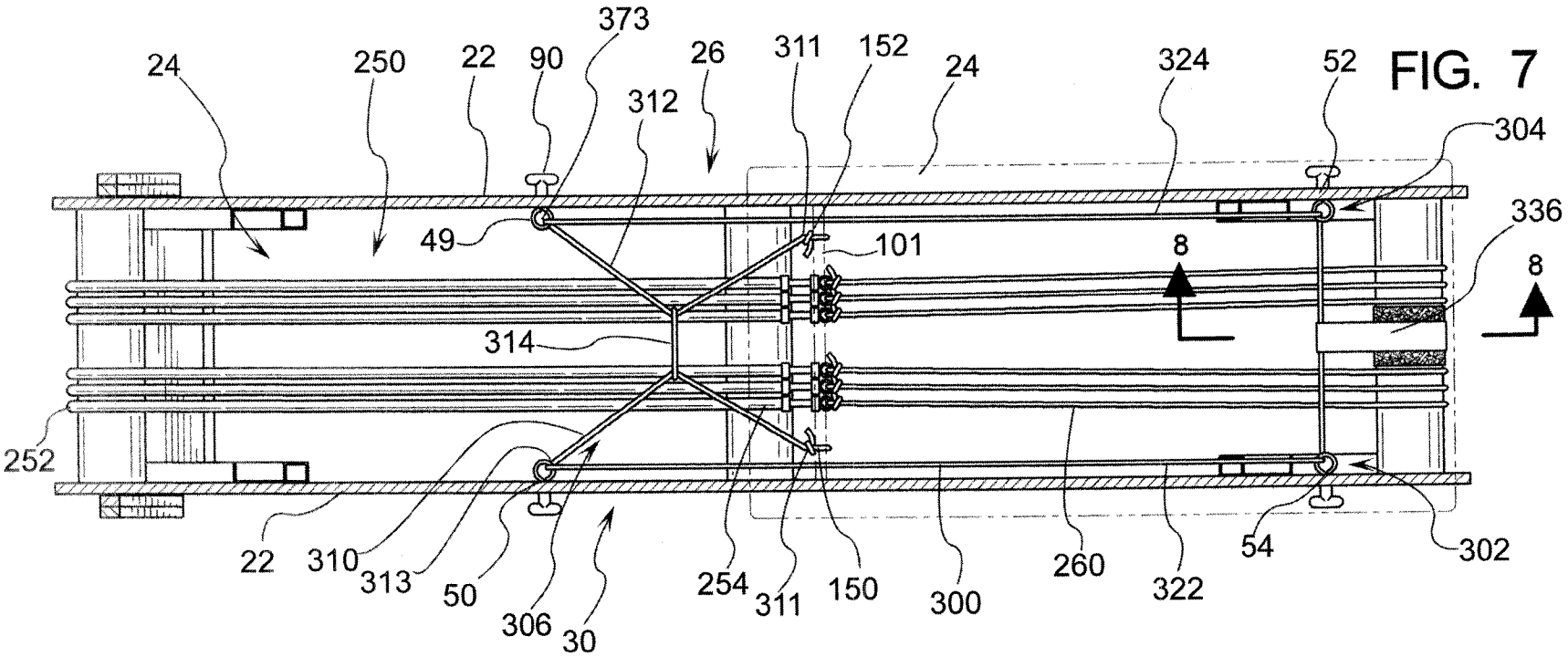
FIG. 7 is taken along lines 7-7 of FIG. 3 showing in greater detail the motion control/rebound system and the resistance system.
Figure 8:
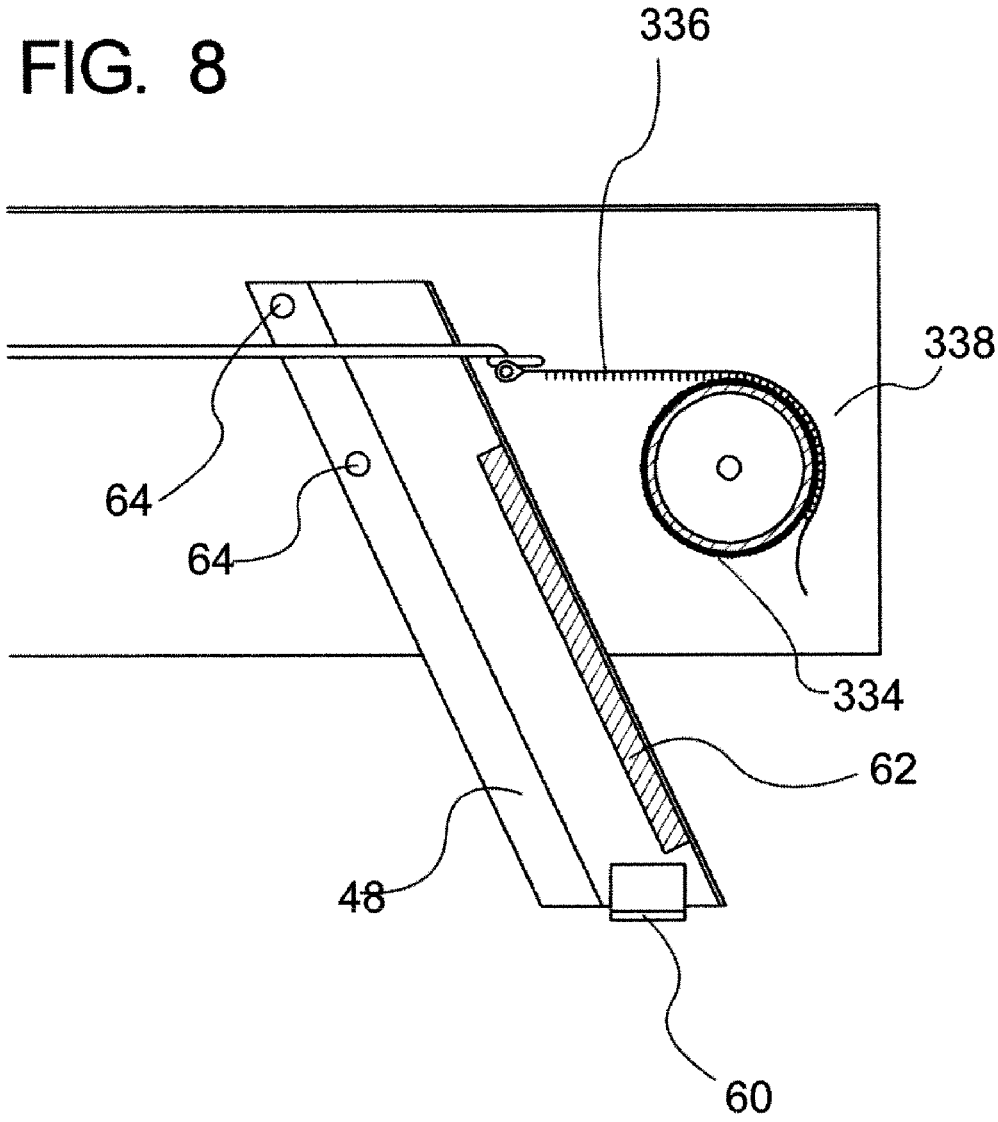
FIG. 8 is a sectional view showing an adjustment feature of the motion control system.

Now referring to FIG. 6, it can be seen how the laterally extending member 100 in one form provides anchor points 150 and 152 for attachment of the control cord 300 which is described further herein with a detailed discussion of the rebound system 30, with reference to FIG. 7. It should be noted of course that the carriage 24 can be oriented in a plurality of manners where for example the anchor points 150 and 152 could be configured on the longitudinal frame members 96 and 98. Now referring to FIG. 12 and describing the carriage 24, it can be seen how the longitudinally extending frame members terminate near a footrest member 160. The footrest member in one form extends below the upper surface 82 of the base member 80 for more of a desirable ergonomic orientation for the exercise participant. Further, the footrest member 160 having the base portion 162 can extend underneath the kick plate when in a stowed orientation such as that as shown in FIG. 1. In one form the footrest member 160 is padded for the comfort and safely of the exercising participant.

Referring now back to FIG. 1, there is shown a side profile view of the apparatus 20 where the foregoing description as discussed the support frame/frame member 22 in detail. Positioned at the foot region 33 of the frame member is the kick plate 28. As shown in FIG. 1, the kick plate is in the stowed or horizontal orientation, and in the left-hand portion of FIG. 1 the kick plate 28' is in the operable or vertical orientation. Of course it should be noted that in the stowed orientation the apparatus 20 is still of course operable but can operate in a different fashion such as a treatment table, traction table, or the like.

In general, the kick plate 28 comprises a base frame 180 and a participant engagement region 182. The base frame 180 is pivotally attached at the foot region 33 of the support frame/frame member 22. In one form, the base frame 180 is pivotally attached near or at the spreader bar 36 where a linkage member 186 is fixedly attached to the support frame/frame member 22 as shown if FIG. 1. Of course, the base frame 180 can be pivotally attached to the main structural support frame/frame member 22 in a variety of manners. As shown in FIG. 3, the kick plate 28 is in the operable position and referring to FIG. 15, it can be appreciated the linkage member 186 can provide structural support and further orientate the pivot point indicated at 190 (not shown in FIG. 15) to a more central longitudinal location of the apparatus 20. In one form the kick plate 28 can extend footwardly beyond the frame.

Figure 15:
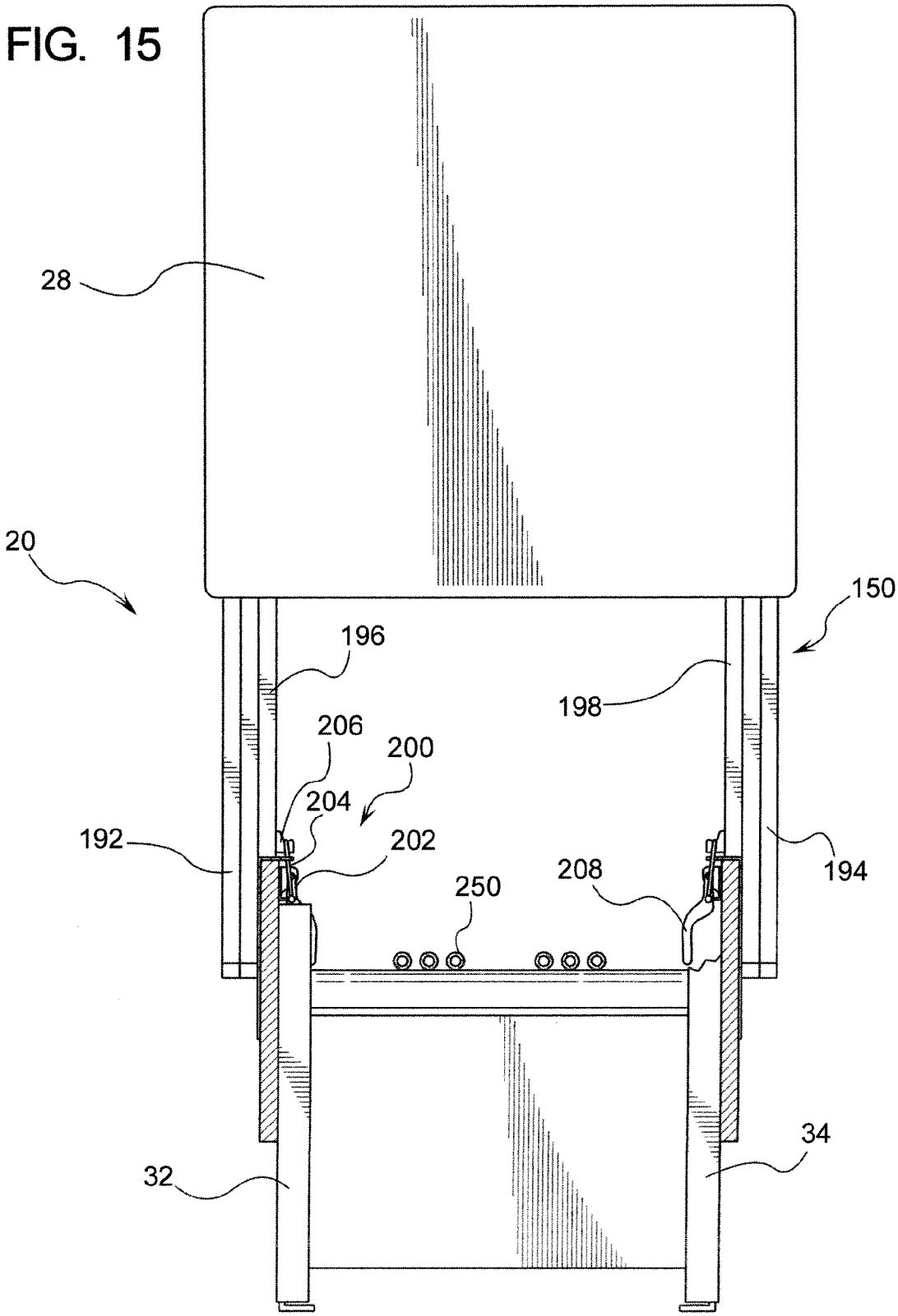
FIG. 15 is a sectional view taken along lines 15-15 of FIG. 4.

Still referring to FIG. 15, there is a view taken along line 15-15 of FIG. 4 where it can be seen that the base frame 180 is comprised of the support frame members 192 and 194. In one form, positioned laterally inwardly are the members 196 and 198. The kick plate locking mechanism 200 in one form is a latch like system terminated where locking mechanisms are positioned at the inward portions of the members 196 and 198 and a conventional loop like lock member 202 has a pivotally attached rigid loop member 204 as positioned around the receiving portion 206 and a handle like mechanism 208 provides leverage to lock the kick plate 28 in a vertical orientation. Of course, any number of types of locking mechanisms can be employed.

Referring now to FIG. 3, the participant engagement region 182 of the kick plate comprises first and second portions 210 and 212. The first portion 210 is primarily engaged in the operable configuration such as that shown in FIG. 3. In general, this material is substantially sufficiently robust to handle impacts placed thereon and having for example shoes or bare feet of an exercising participant engage as described further herein in particular with reference to FIGS. 16-28 as described herein below. As shown in FIG. 15 the first portion 210 is in a stowed or horizontal orientation where there is sufficient clearance between the kick plate 28 and the interface region 217 where the outer surface 214 is in substantially a planar relationship with the upper surface 82 as described immediately below.

Still referring to FIG. 1, the second section 212 is, in one form, a similar material as the base member 80 where this for example would be more softer foam type material that has a similar feel and compression rate as the base member 80. The second section 212 has an outer surface 214 where, as shown in FIG. 1, the kick plate 28 is orientated in a manner where in the stowed position the surfaces 214 and 82 are substantially in a planar relationship. As further described herein, the surfaces 214 and 82 are also somewhat contiguous in nature however, after a thorough discussion of the range of motion control system 30 the net length of the support surface can be altered. Of course by having the surfaces 80 and 214 substantially in-plane, there of course can be deviations but this is broadly defined so the two surfaces can operate as a proper horizontal surface for use of say for example a therapeutic type table. Of course, the surfaces may not be perfectly in the same plane and say for example one of the padding is a little bit thicker for specific therapeutic reasons, but to be substantially in plane, the surfaces are reasonably contiguous to operate as a for example treatment table.

The surfaces 214 and 82 are generally referred to as a table surface generally indicated at 215 in FIG. 1. When the apparatus 20 is functioning as a support surface 215, the combined surfaces 214 and 82 provide sufficient surface area for a plurality of therapeutic treatments or simply a general surface which is utilized in treatment centers, athletic facilities, home use or elsewhere where the apparatus 20 is implemented. It should be noted that the support surface 215 need not be absolutely contiguous where the interface region 217 can be slightly separated to lengthen the overall longitudinal length of the support surface 215. In one form, as described below, the rebound control system can be utilized to allow this separation between the foot plate 28 and the carriage 24 to lengthen the support surface 215.

Figure 10:
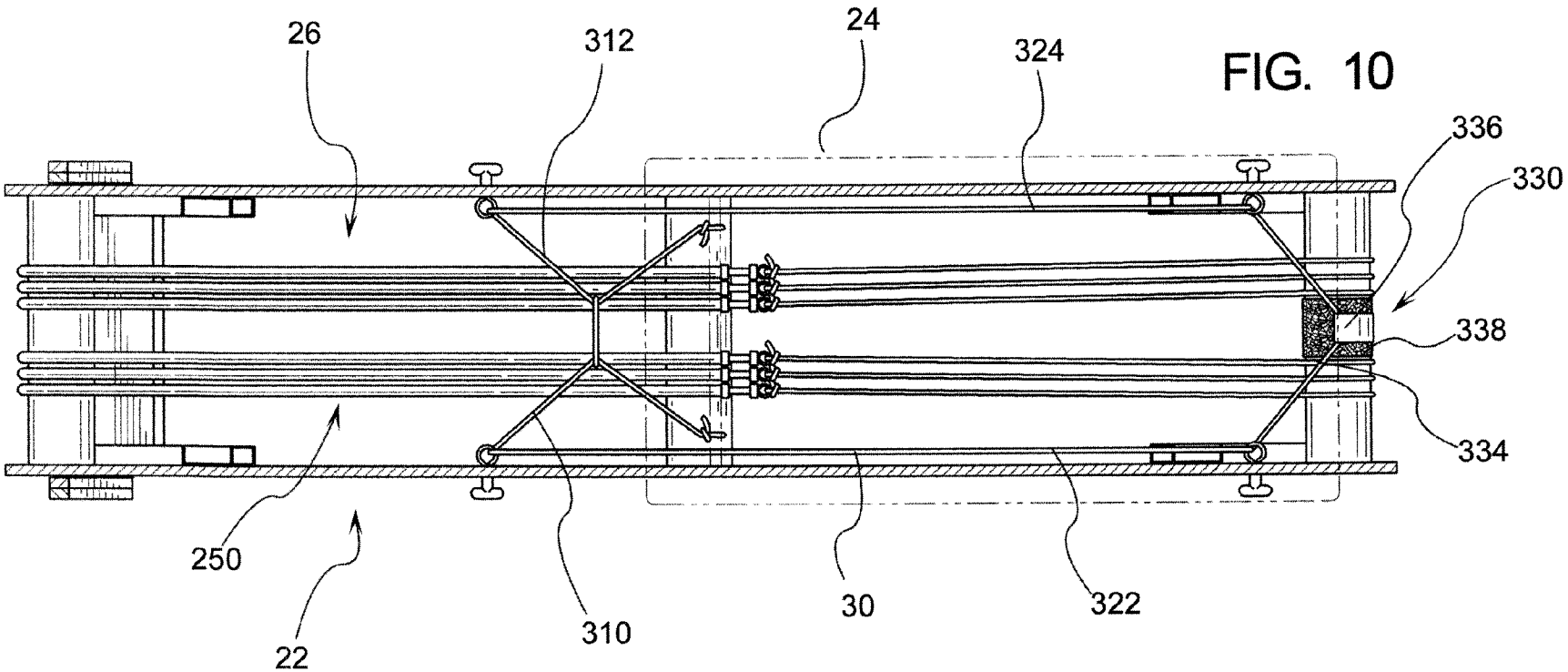
FIG. 10 shows how the adjustment system of the motion control system is utilized to shorten the length of cords that are in engagement with the carriage.

With a thorough discussion of the support frame/frame member 22, the carriage 24 as well as the kick plate 28 in place, there will now be more detailed discussion of the resistance system 26 with initial reference to FIG. 10. In general, the resistance system 26 operates to provide an adjustable amount of resistance between the carriage 24 and the support frame/frame member 22 in a longitudinal direction. It is desirable to have a user-friendly, accessible resistance system 26 for adjusting the amount of resistance applied to the carriage 24.

In general, the resistance system 26 is comprised of a plurality of elastic members 250. For convenience purposes each of the members as described herein will be described with the numeral 250 with the alpha character "a", "b", etc. positioned adjacent thereafter. As shown in FIG. 7, all of the elastic members 250 are in an engaged orientation where they are fixedly removably attached to the carriage 24 at the elastic member attachment portion 101 as shown in FIG. 5. As described above, the surfaces 142 defining the vertically aligned slots 147 as shown in FIG. 5 are adapted to engage the terminal portions of the elastic members 250. Of course, there are a plurality of methods of attaching the elastic members 250 to the carriage but this is one chosen form. It should be noted that the term elastic member is defined broadly for any type of member that resists expansion from a one length to another. In one form, the elastic members are comprised of a conventional bungee cord type material. Of course, in other forms various forms of helical springs or the like can be utilized. Further, if the elastic members 250 are for example loops of some sort, the loop portion could engage for example vertically downward extending portion between two adjacent slots 147 in FIG. 5. Or additionally, if a loop is simply positioned in the end portion of the elastic of the elastic member 250, this loop portion can engage a vertically oriented pin on the carriage.

Referring to FIG. 7, in general the elastic members 250 comprise a first end 252 and a second end 254. Now referring to FIG. 12, there is shown a side cross sectional view of the unit taken at line 12-12 of FIG. 11. As shown in this figure, there is shown one elastic member 250*a* in a disengaged position and one elastic member 250*b* in an engaged position.

Referring back to the discussion of the spreader bar 38, it is desirable to have the elastic member 250*a* and more particularly the attachment cord 260*a* in a more vertically upright orientated position when in the disengaged position so the therapist or other individual adjusting the tension can more readily grasp the central portion of the attachment cord 260*a* and reposition the elastic member 250*a* and to an engaged orientation such as that as shown as the elastic member 250*b*. It should be noted that when in an engaged orientation, the attachment cord as shown at 260*b* is allowed to drop in the general region indicated at 266 as the carriage 24 repositions in a longitudinally head ward direction. Of course this type of attachment system is similar to that as shown in U.S. Pat. No. 6,831,122 which in its entirety is incorporated by reference.

Now referring to FIG. 13, there is shown one form of an attachment system indicated at 270 for the elastic members 250. The first end 252*b* of the particular cord 252*a* can be attached by way of having a cord insert 272 which in form can be an eyebolt or the like. A fixing cord 274 is provided where a surface 276 of the spreader bar 36 provides an opening 278 which is of sufficient diameter to allow the fixing cord 274 to pass therethrough. Therefore, when the cord 252*a* is under tension, given the sharp angle generally indicated at 280 of the cord, there is enough frictional resistance where the cord 252*a* will remain in place even when under a high tension. It should be further noted that as the dynamics of the properties of the elastic member for example 250*a* changes, certain members may have a different spring coefficient and other adjacent members. Or further, a certain amount of pretension may be more desired. Therefore, a simple adjustment system is to reduce the slack within the elastic member 250*a* and reposition the fixing cord 274 having the internal end 282 be further extended therein the central chamber region 284 of the spreader bar 36. Of course, the total length of the elastic member can be lengthened in a similar matter by withdrawing the fixing cord 274 from the chamber region 284.

Referring back to FIG. 12, it should be noted that the combination of the elastic member 250 and the attachment cord portion 260 is referred to as a resistance member. It should be noted that on the opposing portion of the elastic member 250, there is shown a similar type of attachment system for the attachment cord portion 260. Where the discussion and above with reference to FIG. 13 is at least in part relevant to the same underlying principles of the attachment portion of the head region of the attachment cord 260*a*.

Now referring to FIG. 14, it can be seen how the chosen attachment mechanism where the second end of mechanism 254 has an attachment portion 290 which in general has a head portion 292 that is of a greater diameter than the neck region 294. Therefore, the neck region is adapted to engage the slots 147 as shown in FIG. 5 where the head portion 292 applies a force in a longitudinal direction thereto. As shown in FIG. 14 it should be noted that the extension members 143 have a slight longitudinally headward slant at the headward extension indicated at 296 to help maintain the attachment portion 290 with the carriage 24 during operation. It should be further noted that in one form, the resistance system is such where the elastic members do not ride with the carriage. Of course, other embodiments could be employed where the elastic system moves with the carriage and is selectively attached to the frame to provide progressive resistance.

The foregoing description in mind, there will now finally be a discussion of the rebound system 30. It should be noted that the rebound system 30 is further described as a range of motion control system. Referring now to FIG. 7 which is a sectional view taken at line 7-7 of FIG. 3, there is shown the rebound system 30 which in part is comprised in one form, the control cord 300 is a continuous piece of material as a unitary type structure. However, of course it could be made into various components.

As shown in FIG. 7, the control cord 300 is comprised of left and right lateral portions generally indicated at 322 and 324. In general, the control cord has an operating region 306 which is adapted to engage the various attachment points with regard to the support frame/frame member 22 as well as the anchor points 150 and 152 with respect to the carriage 24. Therefore, the operating region 306 is comprised of a first cord section 310 and a second cord section 312. Although the first and second cord sections are extendable through the connection points 49 and 50, for purposes of operating the unit, they are partially fixed as will be further apparent as described herein. The operating region 306 further comprises an elastic member 314 which is defined broadly as any type of member which resists separation of the first and second cord sections 310 and 312. In one form, the elastic member can be an elastic like loop with the cord sections 310 and 312 extending there through. Of course in other forms, it could be for example a spring like member attached in the region or the like.

Figure 9:
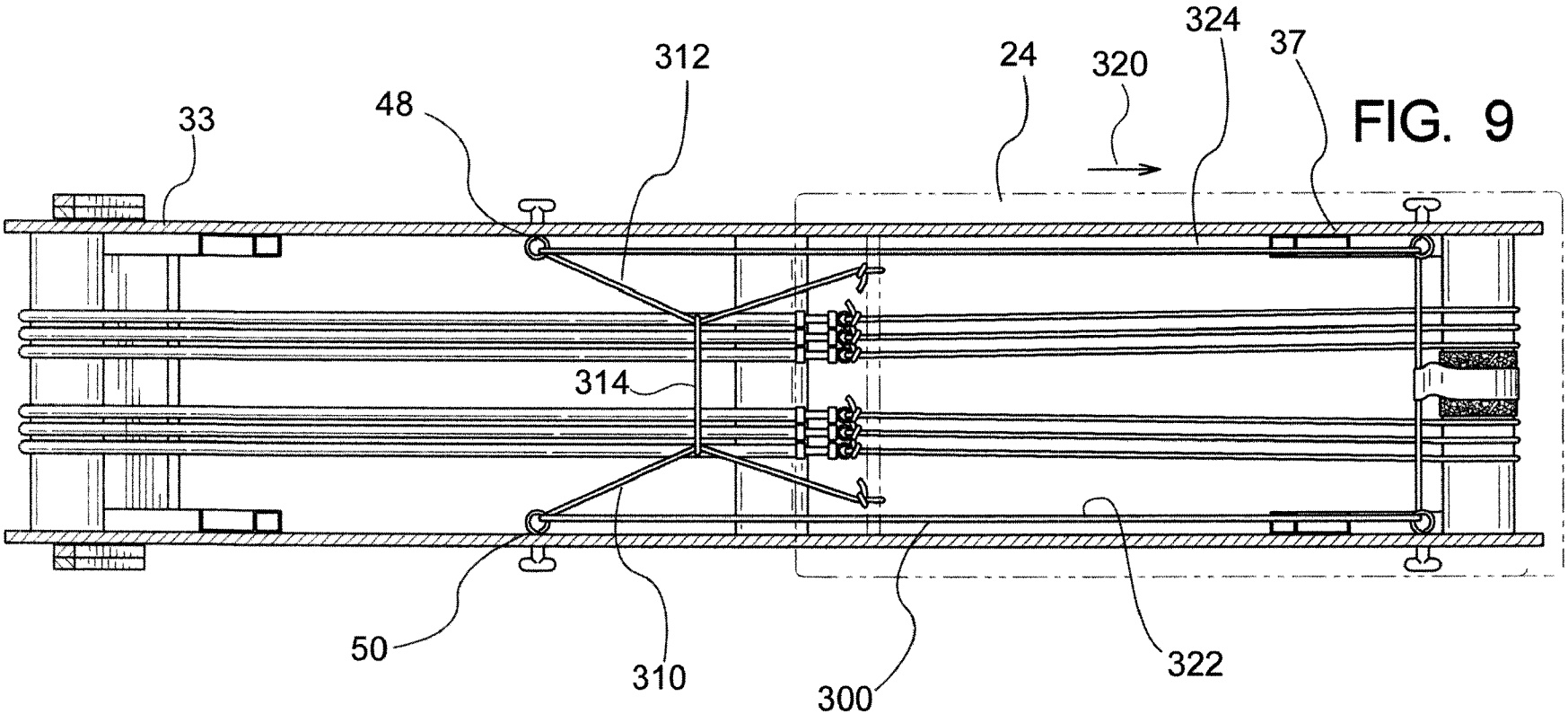
FIG. 9 shows the motion control system in a high-energy state where an intermediate flexible member is resisting separation of two lateral cord members as the carriage is repositioned in a longitudinally head ward direction.

It should be reiterated that the end portions of the first and second cord sections 310 and 312 can be terminated at the anchor points 150 and 152 which are attached to the carriage 24. The other end portions of the cord sections 310 and 312 are attached at the connection points 49 and 50 of the support frame/frame member 22. Therefore, now referring to FIG. 9, it can be appreciated that the carriage 24 is repositioned in a longitudinal headward direction as indicated by the arrow 320. To help aid in resisting the motion in this direction, it can be appreciated how the elastic member 314 is now in a higher stored energy state while the first and second cord sections 310 and 312 are repositioned laterally outwardly. Therefore, it can be appreciated given the basic kinetics of each of the cord sections at say for example referring to cord sections 310 is such that as the carriage 24 continues to be further positioned, the amount of tension in the cord sections 310 and 312 increases exponentially longitudinally head wards. At this point, it should be noted that in one form, the rebound system 30 is configured in a manner where the first and second cord sections 310 and 312 extend around the connection points 49 and 50 which in one form are eye loop members and extend longitudinally rearwardly to the lateral portions generally indicated at 322 and 324. As the carriage 24 extends in that longitudinal direction, tension is applied all throughout the various sections of the control cord 300 and the elastic properties of say for example the lateral portions 322 and 324 are employed to further de-accelerate or otherwise provide a force upon the carriage 24 in the longitudinal foot ward direction (i.e. opposing the direction as indicated by the arrow 320 in FIG. 9). In other forms, it should be noted that a secondary spring could be attached somewhere first or second along the lateral portions 322 and 324.

Figure 11:
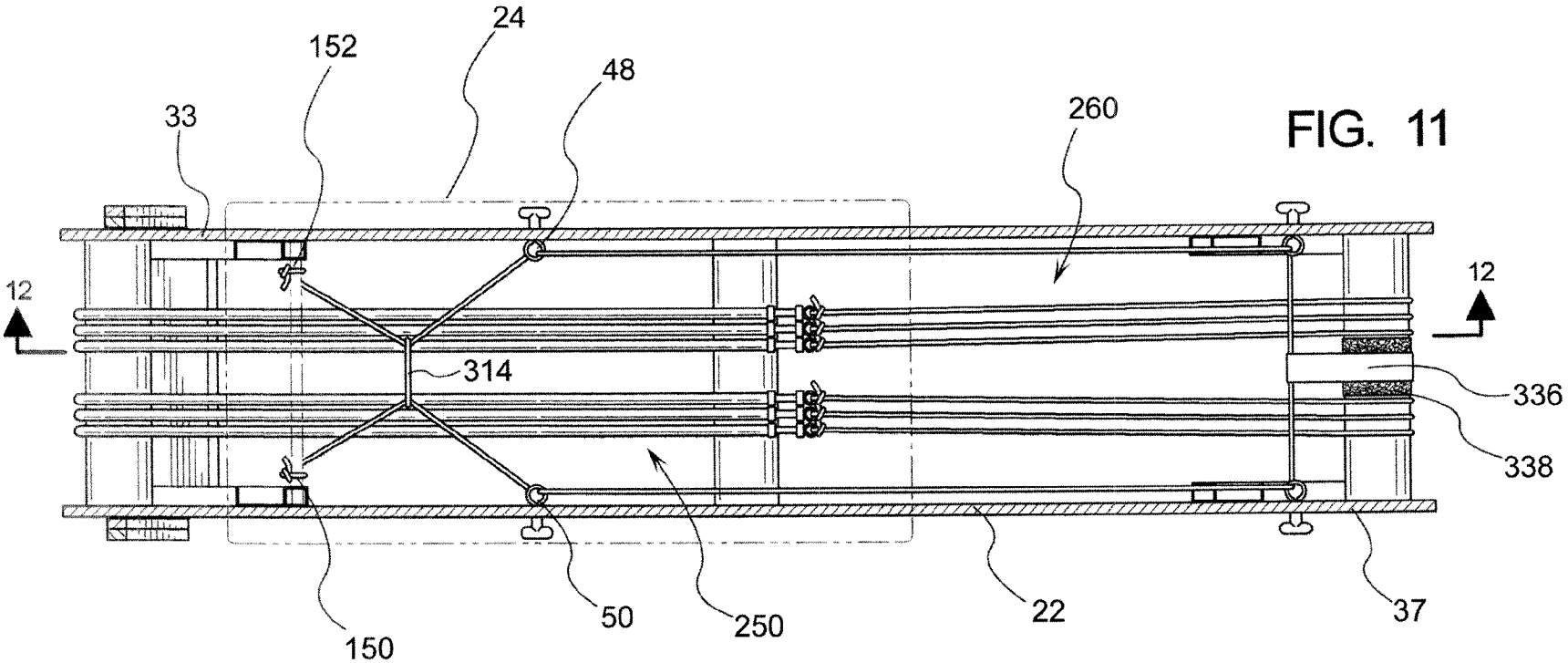
FIG. 11 shows a motion control system where the carriage is in a longitudinally foot ward orientation.

Therefore, it can be appreciated how the rebound system 30 effectively limits the range of travel of the carriage with respect to the frame in one direction. Now referring to FIG. 11, it can be appreciated how the carriage 24 is now re-orientated in the foot region 33 of the support frame/frame member 22. In this form, the anchor points 150 and 152 are positioned in a longitudinal y foot ward orientation with respect to the connection points 49 and 50. Therefore, in the orientation as shown in FIG. 11, the elastic member 314 is now beginning to expand in a lateral direction applying slight resistance opposing the motion of the carriage 24 in the longitudinally footward direction. Therefore, it can be appreciated that in one form the rebound system 30 will resist extreme motion of the carriage 24 with respect to the frame in either extreme longitudinal orientations.

Now referring back to FIG. 10, it can be appreciated that the rebound system 30 has an adjustment mechanism 330 which effectively shortens the length of the first and second cord sections 310 and 312. In one form, the sections of the control cord 300 namely, the lateral portions 322 and 324 are connected at the central portion 334. As mentioned above, the control cord 300 in one form is one continuous strand of material. As shown FIG. 10, the attachment member 336 in one form is a hook and loop like attachment mechanism which is adapted to engage a corresponding hook and loop mechanism 338 which is best shown in FIG. 8. This can be accomplished via hook and loop members of the attachment member 336 and the central portion 334. As shown in this form, the attachment member 336 can be adjustably positioned to effectively shorten the links of the cord sections 310 and 312 such that as shown in FIG. 10 or be relaxed to allow a greater range of motion of the carriage 24 with respect to the support frame/frame member member 22.

Therefore referring back to FIG. 7 which is basically a top view of the unit with the carriage removed therefrom. It can be appreciated that much of the adjustment of the apparatus 20 can be accomplished at the head end. For example, the practitioner can grab any one of the attachment cords 260 for adjusting the resistance from the resistance system 26 as described in detail above. Further, the practitioner can adjust the amount of travel of the carriage 24 by manipulating the length in the longitudinal direction of the attachment member 336.

With respect to cord sections it should be noted that the first and second cord sections 310 each have first attachment regions 311 and second attachment regions 313 where at the second attachment regions the cord sections are effectively attached there to the frame which means either rigidly attached thereto or attached in a manner as shown in FIG. 7 by way of the connection portions indicated at 49 and 50 where the cord extends longitudinally rearwardly along the lateral portions 322 and 324.

Figure 16:
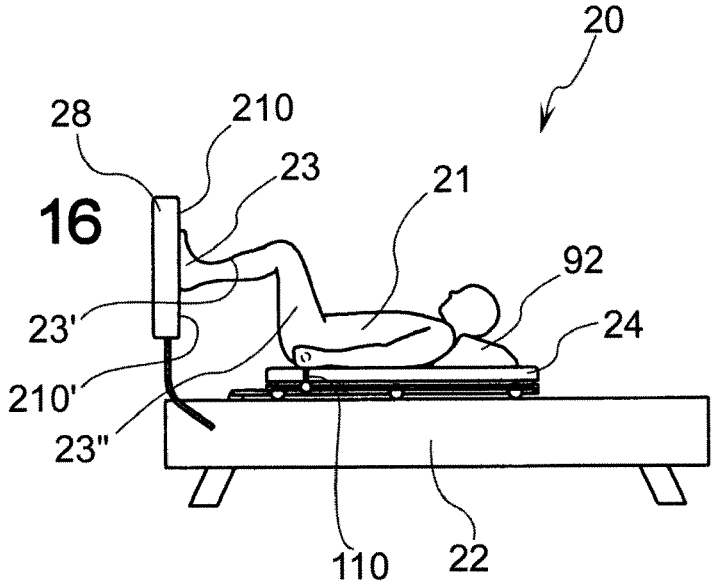
FIGS. 16-28 in general show various types of exercises/therapeutic movements of an exercise participant utilizing the apparatus 20.
Figure 17:
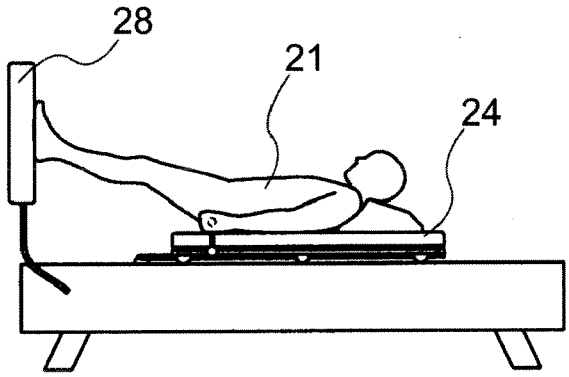
Figure 18:
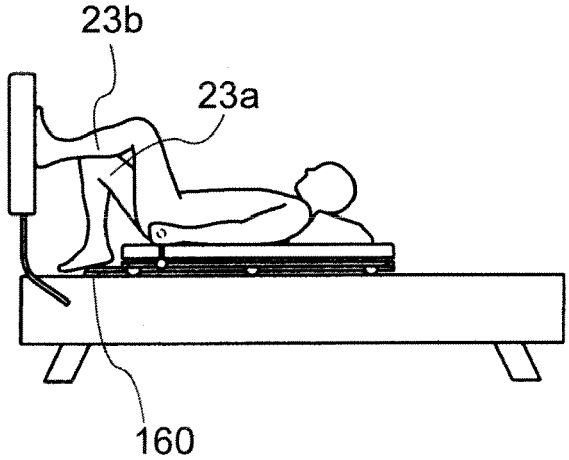
Figure 19:
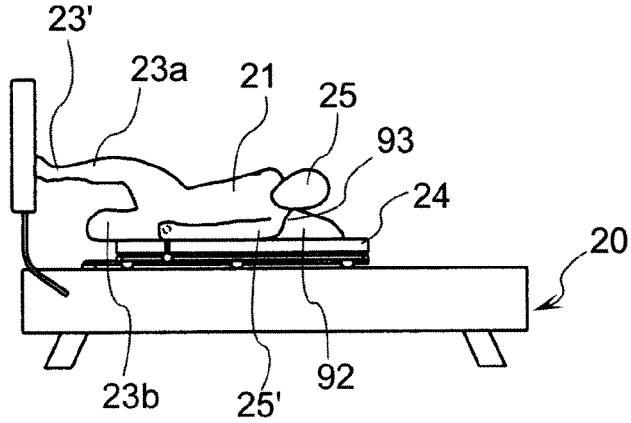

Now referring to FIGS. 16-28, there is shown a variety of exercises/therapeutic movements that can be executed with the apparatus 20. For example, as shown in FIGS. 16, 17 and 18, the individual 21 is positioned in the supine position upon the carriage 24. The kick plate 28 is in the operable orientation where the first portion 210 is orientated in a manner to make contact with the foot region 23 of the individual 21. Prior to engaging in the exercise, the selected degree of resistance is applied to the carriage by way of the resistance system described above. Further, the range of motion of the carriage 24 with respect to the support frame/frame member 22 is adjusted by way of adjusting the rebound system 30 as described above with reference to FIGS. 9 and 10 by adjusting the attachment member 336. Further, the headrest 92 is adjusted on the carriage to allow for a proper orientation of the central torso region of the individual 21 on the carriage. In one form, the kick plate 28 is a fixed structure relative to the frame when in the operable orientation. Therefore, to adjust the degree of bend within the leg portions 23' and 23", the torso of the individual 21 is adjusted by way of repositioning the headrest. Further, the handle members are adjusted where the handle member 110 as shown in the left-hand portion of the unit is adapted to reposition along the attached guide rail for proper ergonomic orientation with the individual 21. Of course, the hand members are in some forms optional where the resistance is very slight, or otherwise there is a sufficient amount of counteracting force between the individual 21 and the carriage 24 so the individual does not slide off the carriage.

Still referring to FIG. 16, it can be seen that the exercise participant is ready to engage in a therapeutic/exercise movement. Therefore, the lower limb 23' is positioned at a desirable orientation upon the first portion 210. It should be noted that the first portion 210 has a sufficient dimension which in FIG. 16 is orientated in the substantially vertical direction to allow for a plurality of leg positions. For example, if the individual desires to have more of a direct pressure along the lower limb 23' where the knee joint presses a resultant force directly downward to prevent any shearing-type action in the knee in the event there is, for example, a meniscus injury, it would be desirable to provide enough of the material of the kick plate 28 in a vertical orientation so the individual's foot 23 is placed sufficiently high enough to allow for such direct downward pressure along the lower limb 23'. However, if the individual wishes, for example, to work more of the quadriceps and has healthy patella tendons, the exercise participant may position his or her foot 23 in the lower region indicated at 210" of the first portion 210 and may be up on the balls of his or her feet to work the quadriceps and perhaps allow for a greater range of motion with respect to the lower and upper leg limbs 23' and 23".

Now referring to FIG. 17, it can be appreciated how the carriage 24 is repositioned in the head ward longitudinal region and the leg portions of the individual 21 have now a more extended orientation. In some forms, the exercise participant may accelerate sufficiently to separate from the kick plate 28.

It should further be noted of course that the kick plate 28 could be readily repositioned from the hatched line 28' as shown in FIG. 1 to the stowed position, and the apparatus 20 can then serve as a therapy table or as a horizontal surface for any purpose.

Figure 15A:
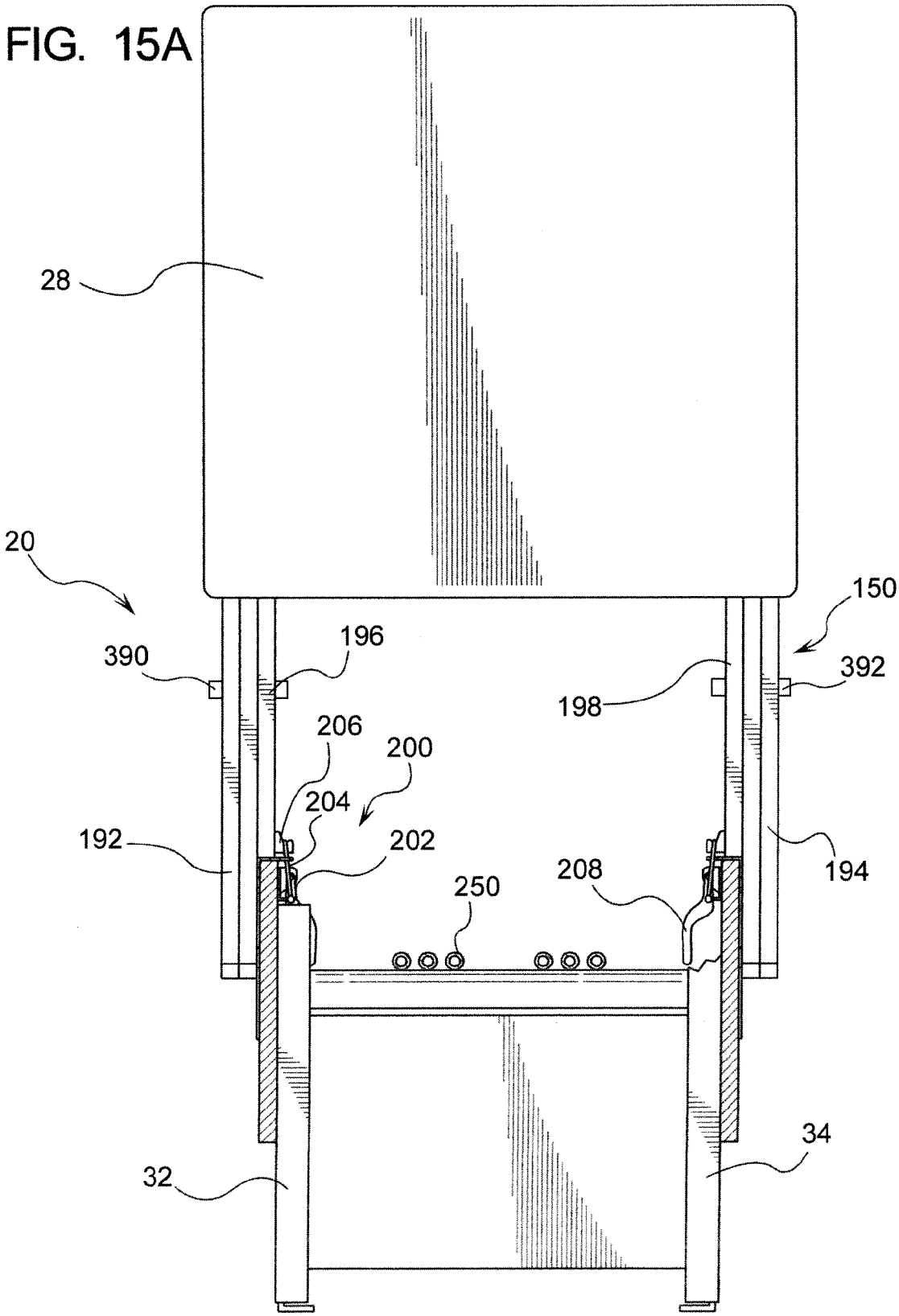
FIG. 15A includes attachment mechanisms.

It should be noted, as shown in FIG. 15A, that the various vertically extending members comprising the supports 192 and 196 on the left hand portion, for example, could be coupled together to prevent flexion amongst the members by the attachment mechanisms 390 and 392.

Figure 15B:
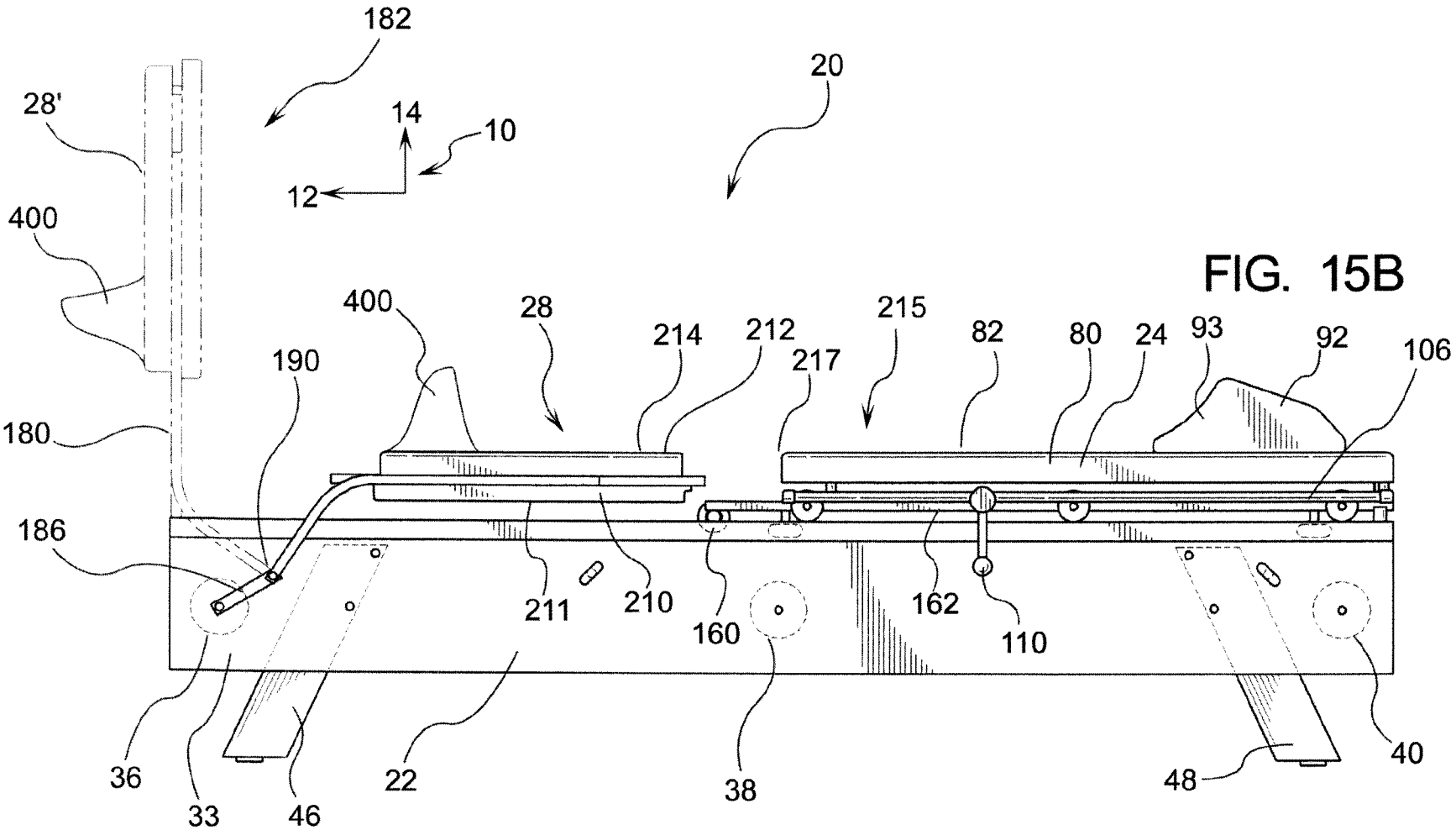
FIG. 15B shows the foot rest member.

Now referring to FIG. 15B, it should be further noted that at the surface indicated at 214, a platform 400 can be placed thereon when the unit is in a stowed orientation, and this platform-like device would have a vertically extending portion that is adapted to have force imparted by the exercise participant. Therefore, in the stowed position, the unit can be utilized as an exercise therapeutic device in a similar manner and concept as in the operative orientation, but utilizing a modified-type kick plate. Therefore, the platform 400 can be a hook-and-loop removal platform in a similar manner as the headrest, or can be a permanently or more rigidly attached-type fixture. In one form, the footplate can reposition in the longitudinal direction 12 to provide some range of motion for the exercise participant. Further, this adjustment can be utilized when in the operational orientation to adjust the height of the kick plate with respect to the frame member.

Figure 15C:
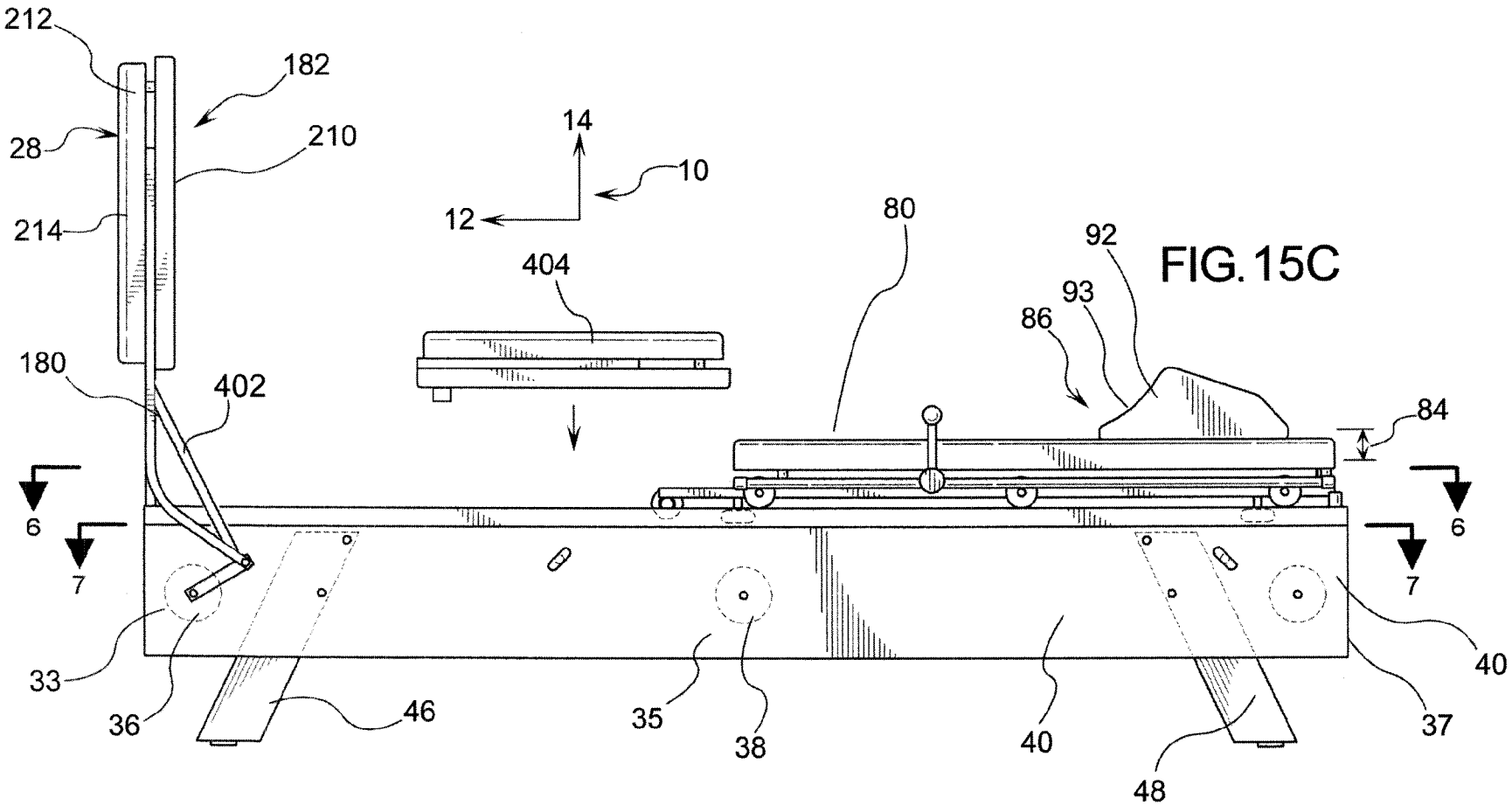
FIG. 15C shows an additional support member.

Referring now to FIG. 15C, there is shown another embodiment where the kick plate 28*a* can be a fixed-type kick plate where the members 402 are positioned to triangulate the forces to provide greater rigidity for the kick plate. The insert 404 is provided to create a table-like member for the unit when in a stowed orientation. In one form, the member 402 can be attached, for example, to the rearward portion of the kick plate.

It should further be noted that when the second surface of the kick plate and the upper surface of the carriage are in the stowed position, the surfaces are adjacent to one another, which is broadly defined as the surfaces being in sufficiently close proximity to operate as a table. Of course, the term adjacent and in-plane could be interpreted in a number of broad ways, for example the padding in one of the materials could be greater where the resting surfaces of either the carriage of the kick plate may extend vertically beyond the other. However, when compressed down, the surfaces are can be positioned in closer proximity to one another.

Figure 20:
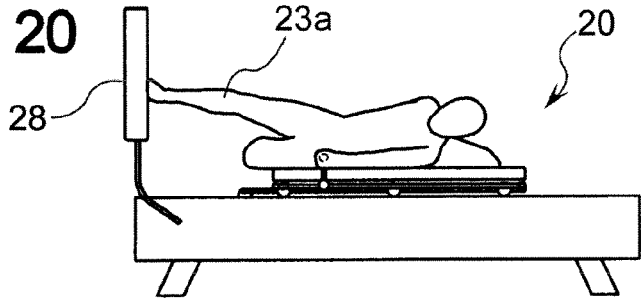

Now referring to FIG. 18, there is a variation of the exercise where the leg portions 23*a* is resting upon the footrest member 160 and the lower leg member 23*b* is being worked. Now referring to FIG. 19, it can be appreciated how the individual 21 is positioned in a slightly oblique manner where he or she has rotated about a longitudinal axis where their left shoulder is in engagement with the upper surface of the carriage 24. In this form, the individual's head 25 is positioned upon the headrest 92, and their shoulder region 25' can engage the forward surface 93 of the headrest 92. In this form, the upper surface of the carriage has a sufficient lateral width to allow for the lower leg member 23*b* to be positioned upon the lower surface region and the forward longitudinal direction of the carriage 24. In this fashion, the upper leg member 23*a* can provide a slightly different orientation where the individual can position the lower leg member 23*b* in a variety of orientations for different kinematic effects upon the body. FIG. 20 shows the leg 23*a* in an extended positioned.

Figure 21:
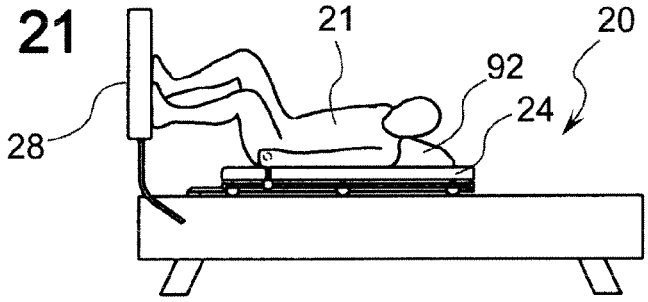
Figure 22:
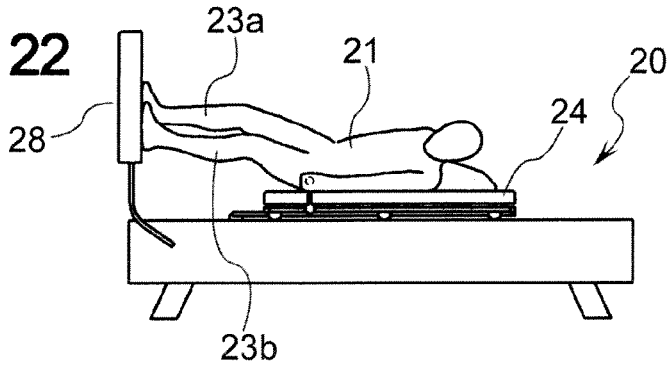

Now referring to FIGS. 21 and 22, it can be seen that the individual 21 is still orientated in the oblique orientation where their left shoulder is positioned upon the upper surface of the carriage 24. It should be noted that the pliable headrest 92 can operate as a shoulder support and be quite versatile in positioning an individual for a variety of body orientations with respect to the apparatus 20.

As shown in FIGS. 23 and 24, there is shown another type of exercise where the individual places his or her lower leg member 23*b* on the footrest member 160, and the opposing leg 23*a* presses off the kick plate 28. In this form, the individual 21 can work on their hamstring therapy.

Figure 25:
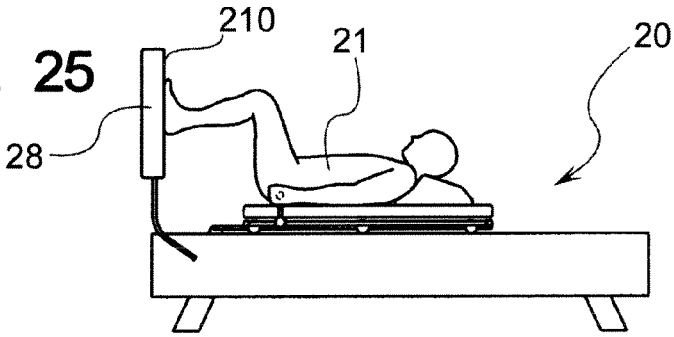
Figure 26:
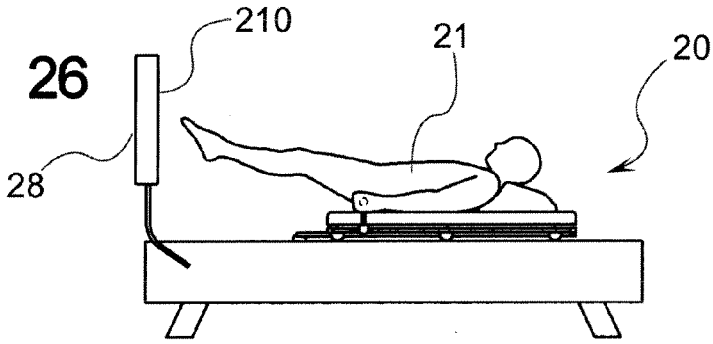

Referring to FIG. 25, there is shown more of a dynamic type of exercise where the individual 21 generates a sufficient amount of thrust of the kick plate 28 to project them from the first portion 210 such as that shown in FIG. 26.

Figure 27:
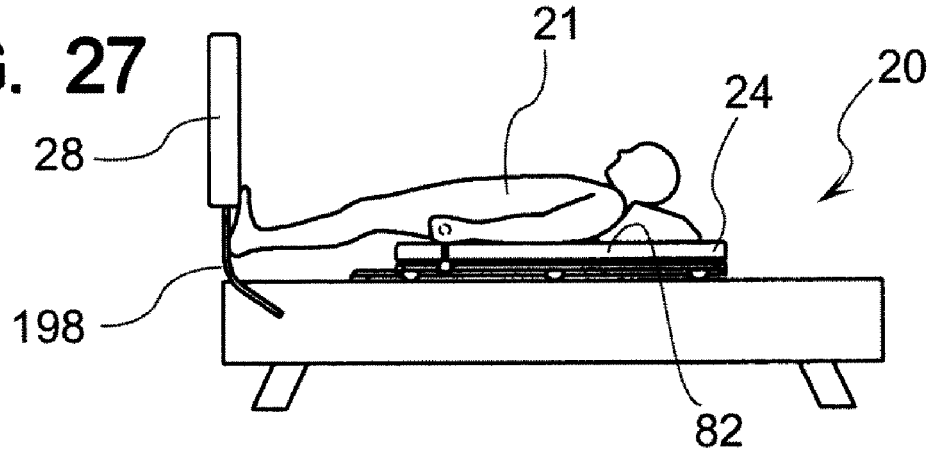
Figure 28:
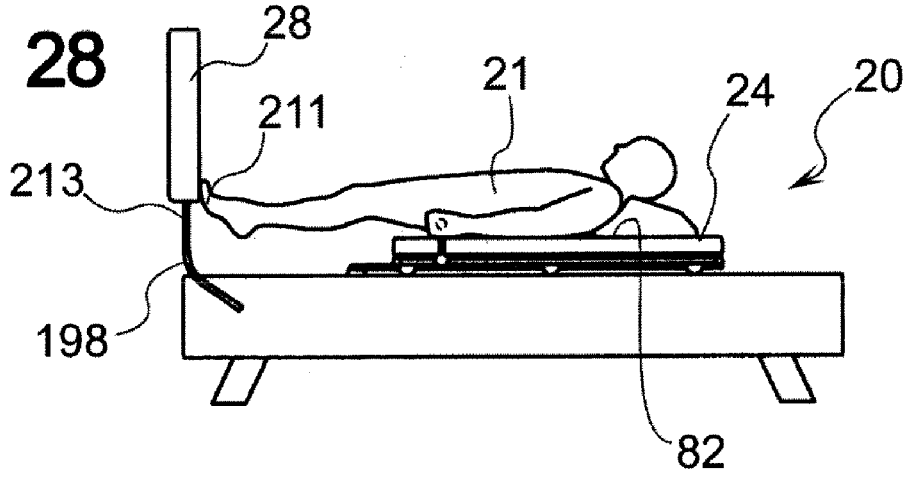

Now referring to FIG. 27, there is shown yet another embodiment where the lower portion 211 of the kick plate 28 provides a central open area 213 between the left and right supports where the support 198 is shown in FIGS. 27 and 28. Therefore, the user can engage in a toe raise-type therapeutic/exercise movement to work the gastrocnemius of the lower leg. It should be noted that the lower ridge on the lower portion 211 is positioned sufficiently above the upper surface of the carriage 24 to allow for a proper ergonomic orientation of the upper torso of the individual 21 with respect to their leg orientation. For example, the lower ridge on the lower portion 211 can be placed at for example eleven inches or six to thirteen inches in one range, or three to seventeen inches in the broader range, above the plane defined by the upper surface 82 of the carriage 24.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. An exercise apparatus for an individual comprising:

a) a frame having a foot end, a head end, a leftward portion, and rightward portion;

b) a carriage having a footer portion, a header portion, a vertically upward surface, a vertically downward surface, a leftward lateral side and a rightward lateral side, the carriage being movably coupled to the frame to travel back and forth longitudinally along the frame;

c) a plurality of elastic members coupled to the frame on a first end and removably coupled to the carriage on a second end, d) where a vertically extending member of the carriage comprises an attachment system where said surfaces define a plurality of slots of attachment regions positioned vertically to approximately correlate to the lateral position of elastic members of the resistance system, and e) a kickboard movably attached to the frame toward the foot end of the frame such that said kickboard is rotationally positionable in a horizontal and a vertical position having a vertically upward surface and a vertically downward surface when in the horizontal position and the vertically upward surface of the kickboard when in the horizontal position is substantially aligned with the vertically upward surface of the carriage when the kickboard is in the stowed position and sufficiently proximate thereto said carriage for supporting the individual positioned on the upward surface on the kickboard and the vertically upward surface of the carriage so the kickboard and the carriage surface areas collectively operate as a treatment table.

2. The exercise apparatus as recited in claim 1 wherein the vertically upward surface of the carriage and the vertically upward surface of the kickboard when in the horizontal position are padded.

3. The exercise apparatus as recited in claim 1 further comprising a plurality of lateral control wheels coupled to the carriage configured to enable the plane of rotation of the lateral control wheels is in a plane parallel with the longitudinal movement of the carriage along the frame and the lateral control wheels contact or intermittent contact with an L shaped bracket coupled to the frame wherein the L shaped bracket prevents the carriage from becoming detached from the frame and reduces friction between the carriage and the frame.

4. The exercise apparatus as recited in claim 1 further comprising a plurality of vertically oriented wheels configured to support the weight of the carriage and an exercising participant above a frame member wherein the plane of rotation of the vertically oriented wheels is parallel to the longitudinal movement of the carriage along the frame and perpendicular to the lateral axis of the exercise apparatus.

5. The exercise apparatus as recited in claim 1 further including a headrest positionably coupled to the vertically upward surface of the carriage such that the longitudinal and/or lateral position of the headrest can be changed without tools.

6. The exercise apparatus as recited in recited in claim 1 where a locking mechanism is employed to orientate the kickboard in an operable orientation.

7. The exercise apparatus as recited in claim 6 where the locking mechanism comprises a loop leverage fastener where the kickboard further comprises a downward extending members having each having a receiving portion where a loop member is pivotally attached to the base frame and adapted to replace a downward force upon the downward extending members of the kick plate.

8. The exercise apparatus as recited in claim 1 where a rebound system is provided and is comprised of a first and second cord sections where the first ends of the cord sections are attached to the carriage and second ends are operatively attached to the frame and the first and second cord sections have an elastic member attached thereto to resist lateral displacement of the first and second cord sections.

9. The exercise apparatus as recited in claim 8 where the first and second cord sections are further attached to first and second cord extension portions where the length of the first and second cord sections are adjusted by adjusting the length of the first and second cord extension portions and the first and second cord portions are attached to one another in a central location and a fastener is attached thereto which is fixedly and removably displaced in a longitudinal direction to adjust the lengths of the first and second cord sections.

10. The exercise apparatus as recited in claim 1 where the carriage is provided with an adjustable head rest positioning system where a headrest comprising a head rest member that is fixedly and repositionally coupled to the carriage such that the longitudinal and/or lateral position of the headrest can be changed without tools.

11. The exercise apparatus as recited in claim 1 where a foot rest member is positioned on the carriage and positioned sufficiently below an upper surface of the carriage member so the kick plate is positioned thereabove the foot rest member when the kick plate is in a stowed position.

12. The exercise apparatus as recited in claim 1 where the resistance system comprises a plurality of elastic members where at least a portion of the elastic members are attached to a portion of the frame where a fixing cord located at a first region of an elastic member at least one of the elastic members extends through an opening at a substantially right angle to the portion of the fixing cord adjacent to the first end of the elastic member to secure the elastic member to the frame via a spreader bar provided to separate first and second longitudinally extending frame members where at least one spreader bar is positioned at a foot region of the frame and includes a surface defining an opening adapted to receive the elastic fixing cord.

13. The exercise apparatus as recited in claim 12 where the frame further includes a spreader bar positioned at a foot region of the frame where the spreader bar provides the opening for the fixing cord of an elastic member and the spreader bar defines an interior chamber region where an internal end of the fixing cord extends therein and the tension of the elastic member is adapted to be changed by way of relaxing the tension in the elastic member and adjusting the length of the fixing cord within the opening.

14. The exercise apparatus as recited in claim 1 where the resistance system comprises at least one elastic member where the elastic member has first and second ends where attached at the first end is a fixing cord that is operatively configured to extend through the opening of a spreader bar to fix the first end of the elastic cord to the frame.

15. The exercise apparatus as recited in claim 14 where the elastic cord further comprises an attachment cord portion that is connected to the second end of the elastic member and further connected to a second spreader bar positioned at the head region of the frame.

16. The exercise apparatus as recited in claim 1 where a motion control system is provided and comprises an operating region having first and second cord sections each having a portion being attached to the frame and an opposing portion attached to the carriage, an elastic member attached to the first and second cord sections resisting separation in a lateral direction of the first and second cord sections.

17. The exercise apparatus as recited in claim 16 where the first and second members extend through contact points of the frame and extend in a longitudinal headward direction where the first and second members are adjusted in length by fixedly and positionally attaching the first and second members to the frame.

18. The exercise apparatus as recited in claim 17 where the first and second cord sections are attached to one another at the headward region of the frame and an adjustment mechanism is provided where an attachment member is configured to be fastened to a spreader bar positioned in the head region of the frame.

19. Therapeutic device for an exercise participant, comprising:

a) a frame, comprising a longitudinal and lateral axis and having a headward region and a footward region in opposing longitudinal regions of the frame, b) a kick plate comprising first and second portions each having first and second surfaces, the kick plate pivotally attached in the footward region of the frame, the kick plate operatively configured to be orientated in an extended orientation and a retracted orientation, c) a carriage movably attached to the frame and operatively configured to reposition along the longitudinal direction, the carriage having an upper surface, d) a resistance system, comprising a plurality of elastic members, the elastic members being operatively configured to be selectively attached between the frame and the carriage to supply selective amount of resistance to resist movement of the carriage from the footward region to the headward region, and plurality of lateral control wheels coupled to the carriage configured so that the plane of rotation of the lateral control wheels is in a plane parallel with the longitudinal movement of the carriage along the frame and the lateral control wheels are in contact or intermittent contact with an L-shaped bracket coupled to the frame wherein the L-shaped bracket prevents the carriage from becoming detached from the frame and reduces friction between the carriage and the frame, e) whereas the kick plate when positioned in the retracted orientation, the second surface and a surface is adjacent to the upper surface of the carriage to perform as a treatment table and when the kick plate is in an extended orientation, the first surface of the first section is provided for the exercise participant to place a force thereon.

20. The therapeutic device as recited in claim 19 further comprising a vertically extending member of the carriage comprising an attachment system where surfaces define a plurality of slots of attachment regions positioned vertically to approximately correlate to the lateral position of elastic members of the resistance system.

* * * * *